US008888580B2

(12) United States Patent
Caputo et al.

(10) Patent No.: US 8,888,580 B2
(45) Date of Patent: Nov. 18, 2014

(54) GAMING SYSTEM, GAMING DEVICE AND METHOD INCLUDING A COMMUNITY TRAIL GAME

(75) Inventors: Scott A. Caputo, Santa Clara, CA (US); Ernest M. Lafky, Oakland, CA (US); Mark C. Nicely, Daly City, CA (US)

(73) Assignee: IGT, Las Vegas, NV (US)

( * ) Notice: Subject to any disclaimer, the term of this patent is extended or adjusted under 35 U.S.C. 154(b) by 449 days.

(21) Appl. No.: 12/914,602

(22) Filed: Oct. 28, 2010

(65) Prior Publication Data

US 2012/0108319 A1 May 3, 2012

(51) Int. Cl.
*A63F 9/24* (2006.01)
*G07F 17/32* (2006.01)

(52) U.S. Cl.
CPC ..... *G07F 17/3276* (2013.01); *G07F 17/32* (2013.01)
USPC ..... 463/20; 463/6; 463/16; 463/42

(58) Field of Classification Search
USPC ..... 463/6, 16, 20, 42
See application file for complete search history.

(56) References Cited

U.S. PATENT DOCUMENTS

| | | | | |
|---|---|---|---|---|
| 3,463,496 | A * | 8/1969 | Weinstein et al. | 273/246 |
| 5,186,460 | A * | 2/1993 | Fongeallaz et al. | 463/6 |
| 5,779,544 | A | 7/1998 | Seelig et al. | |
| 5,823,872 | A * | 10/1998 | Prather et al. | 463/6 |
| 5,980,384 | A | 11/1999 | Barrie | |
| 6,217,448 | B1 | 4/2001 | Olsen | |
| 6,315,660 | B1 | 11/2001 | Demar et al. | |
| 6,605,047 | B2 | 8/2003 | Zarins et al. | |
| 6,869,361 | B2 | 3/2005 | Sharpless et al. | |
| 7,070,505 | B2 | 7/2006 | Vancura et al. | |
| 7,081,050 | B2 | 7/2006 | Tarantino | |
| 7,291,067 | B2 | 11/2007 | Tarantino | |
| 7,393,280 | B2 | 7/2008 | Cannon | |
| 7,427,236 | B2 | 9/2008 | Kaminkow et al. | |
| 7,500,915 | B2 | 3/2009 | Wolf et al. | |
| 7,597,621 | B2 | 10/2009 | Baerlocher | |
| 7,651,392 | B2 | 1/2010 | Pennington et al. | |

(Continued)

FOREIGN PATENT DOCUMENTS

| | | |
|---|---|---|
| EP | 1 260 928 A2 | 11/2002 |
| EP | 1 564 698 A2 | 8/2005 |
| GB | 2 391 375 | 2/2004 |
| WO | WO 2010/002794 | 1/2010 |

OTHER PUBLICATIONS

Search Report and Written Opinion for Singapore Patent Application No. 201105900-3 dated Mar. 29, 2012.

*Primary Examiner* — Lawrence Galka
(74) *Attorney, Agent, or Firm* — Neal, Gerber & Eisenberg LLP

(57) ABSTRACT

In various embodiments, the gaming system, gaming device, and gaming method disclosed herein provides a community game having a trail or path. The community game enables a plurality of players to each simultaneously pick one or more directions of movement along the trail or path (i.e., pick or designate a destination position which that player wants to move to). If the picked directions of movement for more than one player result in more than one player each designating the same destination position, the gaming system determines which player is moved to the designated destination position (and is provided a displayed award or outcome associated with that position) and which player is moved to an alternative position (and is provided a displayed award or outcome associated with that alternative position).

20 Claims, 33 Drawing Sheets

(56) References Cited

U.S. PATENT DOCUMENTS

| | | | | |
|---|---|---|---|---|
| 7,753,782 | B2 | 7/2010 | Cuddy et al. | |
| 7,819,745 | B2 | 10/2010 | Cuddy et al. | |
| 7,828,649 | B2 | 11/2010 | Cuddy et al. | |
| 7,854,654 | B2 | 12/2010 | Baerlocher et al. | |
| 7,857,699 | B2 | 12/2010 | Baerlocher | |
| 8,079,903 | B2 * | 12/2011 | Nicely et al. | 463/20 |
| 2002/0016200 | A1 | 2/2002 | Baerlocher et al. | |
| 2003/0119581 | A1 * | 6/2003 | Cannon et al. | 463/25 |
| 2007/0054732 | A1 | 3/2007 | Baerlocher | |
| 2007/0105619 | A1 | 5/2007 | Kniesteadt et al. | |
| 2007/0123341 | A1 | 5/2007 | Tessmer et al. | |
| 2007/0149270 | A1 * | 6/2007 | Baerlocher et al. | 463/16 |
| 2007/0167217 | A1 | 7/2007 | Kaminkow et al. | |
| 2008/0102916 | A1 | 5/2008 | Kovacs et al. | |
| 2008/0108401 | A1 | 5/2008 | Baerlocher et al. | |
| 2008/0108429 | A1 | 5/2008 | Davis et al. | |
| 2008/0113765 | A1 | 5/2008 | DeWaal | |
| 2008/0113768 | A1 | 5/2008 | Baerlocher | |
| 2008/0113771 | A1 | 5/2008 | Baerlocher et al. | |
| 2008/0311980 | A1 | 12/2008 | Cannon | |
| 2009/0042644 | A1 | 2/2009 | Zielinski | |
| 2009/0088253 | A1 | 4/2009 | Oberberger et al. | |
| 2009/0111560 | A1 | 4/2009 | Davis et al. | |
| 2009/0111572 | A1 | 4/2009 | Bigelow et al. | |
| 2009/0117970 | A1 | 5/2009 | DeWaal et al. | |
| 2009/0117979 | A1 | 5/2009 | Decasa et al. | |
| 2009/0124320 | A1 | 5/2009 | DeWaal | |
| 2009/0124327 | A1 | 5/2009 | Caputo et al. | |
| 2009/0124362 | A1 | 5/2009 | Cuddy et al. | |
| 2009/0124363 | A1 | 5/2009 | Baerlocher et al. | |
| 2009/0124385 | A1 | 5/2009 | Cuddy et al. | |
| 2009/0253492 | A1 | 10/2009 | Caputo et al. | |
| 2009/0275389 | A1 * | 11/2009 | Englman et al. | 463/20 |
| 2010/0016065 | A1 | 1/2010 | Nicely et al. | |
| 2010/0029363 | A1 | 2/2010 | Hoffman et al. | |
| 2010/0041468 | A1 | 2/2010 | Baerlocher et al. | |
| 2010/0048282 | A1 | 2/2010 | Nicely et al. | |
| 2010/0056247 | A1 | 3/2010 | Nicely et al. | |
| 2010/0120494 | A1 | 5/2010 | DeWaal et al. | |
| 2010/0120503 | A1 | 5/2010 | Hoffman et al. | |
| 2010/0120521 | A1 | 5/2010 | Caputo et al. | |
| 2010/0124987 | A1 | 5/2010 | Parham | |
| 2010/0210348 | A1 | 8/2010 | Peterson | |
| 2011/0111827 | A1 | 5/2011 | Nicely et al. | |
| 2011/0230251 | A1 | 9/2011 | Nicely et al. | |

* cited by examiner

Participant A and Participant D are tied for 2nd, but Participant A moves 1st because Participant A is closest to the inside. Participant A submitted a move of 4 positions forward. However, Participant A is blocked by Participant B and can only move 3 positions forward to earn 2 Free Spins.

Despite losing 1 move in the mud, Participant D takes the lead with a roll of 6 plus the previously earned move modifier of 3 moves. Participant D earns a 3x Modifier.

Participant C wanted to move 10 positions forward. However, Participant C gets stopped behind Participant A and only moves 6 positions forward to earn a 2x Multiplier. Round 3 is complete.

Round 4:
Participant D's movement results in
Participant D earning a Pass Through anti-blocker.

FIG. 5

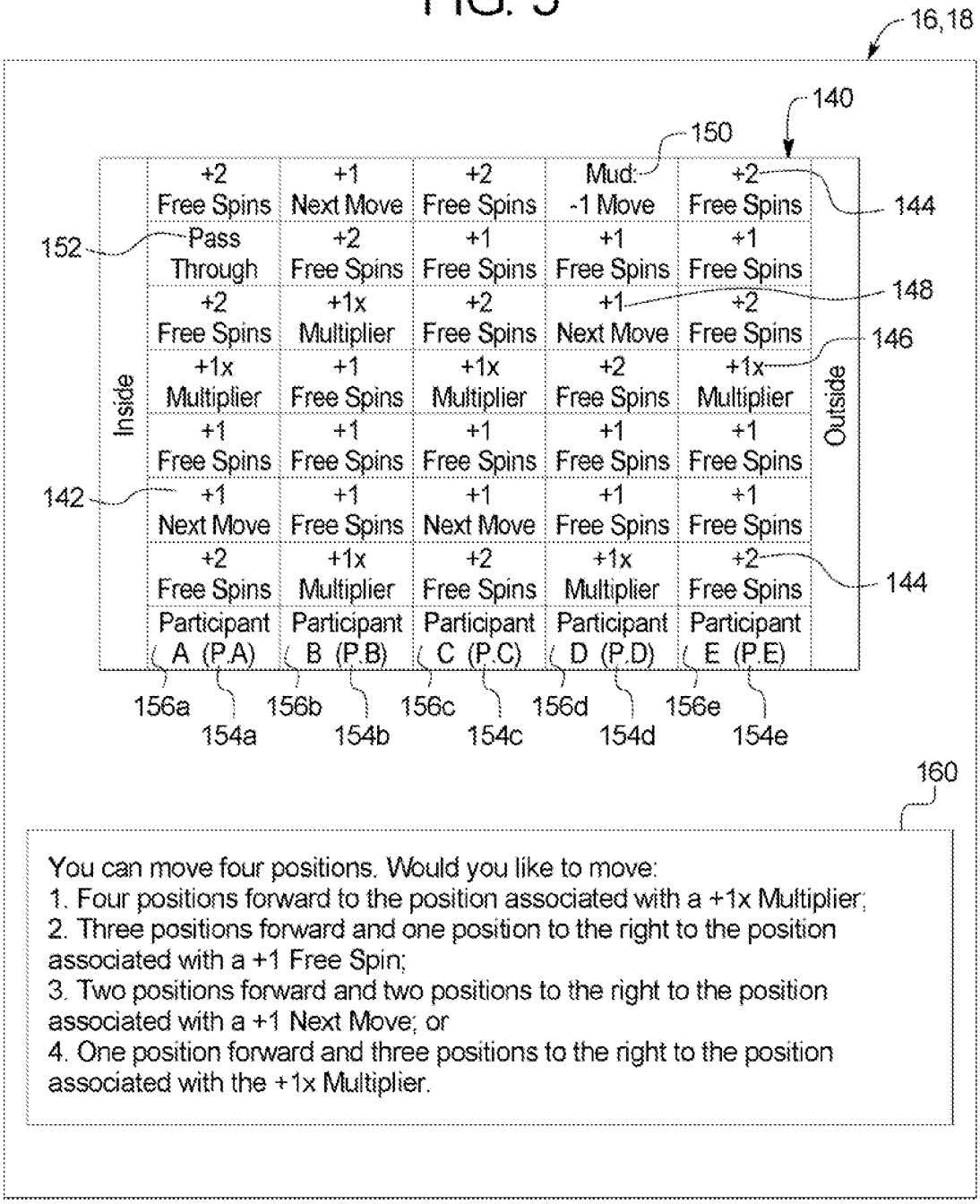

160

You can move four positions. Would you like to move:
1. Four positions forward to the position associated with a +1x Multiplier;
2. Three positions forward and one position to the right to the position associated with a +1 Free Spin;
3. Two positions forward and two positions to the right to the position associated with a +1 Next Move; or
4. One position forward and three positions to the right to the position associated with the +1x Multiplier.

GAMING SYSTEM, GAMING DEVICE AND METHOD INCLUDING A COMMUNITY TRAIL GAME

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming devices which provide players awards in primary or base games are well known. Gaming devices generally require the player to place or make a wager to activate the primary or base game. In many of these gaming devices, the award is based on the player obtaining a winning symbol or symbol combination and on the amount of the wager (e.g., the higher the wager, the higher the award). Symbols or symbol combinations which are less likely to occur usually provide higher awards.

In such known gaming devices, the amount of the wager made on the primary game by the player may vary. For instance, the gaming device may enable the player to wager a minimum number of credits, such as one credit (e.g., one penny, nickel, dime, quarter or dollar) up to a maximum number of credits, such as five credits. This wager may be made by the player a single time or multiple times in a single play of the primary game. For instance, a slot game may have one or more paylines and the slot game may enable the player to make a wager on each payline in a single play of the primary game. Thus, it is known that a gaming device, such as a slot game, may enable players to make wagers of substantially different amounts on each play of the primary or base game ranging, for example, from 1 credit up to 125 credits (e.g., 5 credits on each of 25 separate paylines). Accordingly, it should be appreciated that different players play at substantially different wagering amounts or levels and at substantially different rates of play.

Secondary or bonus games are also known in gaming devices. The secondary or bonus games usually provide an additional award to the player. Secondary or bonus games usually do not require an additional wager by the player to be activated. Certain secondary or bonus games are activated or hit upon an occurrence of a designated triggering symbol or triggering symbol combination in the primary or base game. For instance, a bonus symbol occurring on the payline on the third reel of a three reel slot machine may hit the secondary bonus game. Part of the enjoyment and excitement of playing certain gaming devices is the occurrence or triggering of the secondary or bonus game (even before the player knows how much the bonus award will be).

There is a continuing need to provide new and different gaming devices and gaming systems as well as new and different ways to provide awards to players as a result of one or more player decisions.

SUMMARY

In various embodiments, the gaming system, gaming device, and gaming method disclosed herein provides a community game having a trail, path, matrix or track. The community game enables a plurality of players to each simultaneously (or substantially simultaneously) pick or designate one or more directions of movement along the trail or path (i.e., pick or designate a destination position which that player wants to move to be provided the displayed award or outcome associated with that position). If the picked directions of movement for more than one player result in more than one player each designating the same destination position, the gaming system determines which player is moved to the designated destination position (and provides the player a displayed award or outcome associated with that position) and which player is moved to an alternative position (and provides the player a displayed award or outcome associated with that alternative position). Such a gaming system provides players with an interactive community game in which one player's actions may affect or be affected by another player's actions and accordingly, one player's community game award may be affected by another player's actions during the community game.

More specifically, the gaming system of one embodiment disclosed herein includes a common trail or path including a quantity of displayed positions. Certain of the positions along the path are associated with displayed outcomes, such as awards or movement modifiers. In operation of this embodiment, each participant in the community game is provided a limited number of turns or rounds to move along the common trail. For each participant for each round, the gaming system determines and displays a number of moves which that individual participant can make along the common trail. After determining a number of moves each participant can make for a specific round and before any of the individual participants move along the trail for that round, the gaming system enables each individual participant to designate where they want to move for their determined number of moves (i.e., pick a destination position). It should be appreciated that since the outcomes associated with the positions are displayed to the players, the gaming system enables a participant to decide, based on their determined number of moves and which displayed outcomes are associated with the positions reachable within the determined number of moves, an outcome to attempt to accumulate for that round.

After enabling each participant to designate where they want to move (based on that participant's determined number of moves) for a specific round, the gaming system determines, based on a determined priority of movement, which participants are moved to their designated positions and which participants are unable to move to their designated positions. That is, the gaming system determines, for each participant, if that participant is actually moved to the position that participant wanted to move to or if that participant is blocked or otherwise prevented from moving to the position that participant wanted to move to (and are actually moved to another position along the trail or path). After moving each participant to a position along the path, the gaming system provides each participant the outcome associated with the moved to position and advances to the next round, if any. In certain embodiments, upon the conclusion of the final round, the gaming system provides one or more players an additional award or outcome based on how that player performed in the community trail game (relative to how other player's performed).

In one embodiment, the gaming system disclosed herein displays a matrix including a plurality of different starting positions and a plurality of outcome positions, each of the outcome positions associated with one of a plurality of different outcomes and displays: (i) a player symbol at one of the plurality of different starting positions, and (ii) at least one participant symbol at least one of the plurality of different starting positions. In this embodiment, the gaming system randomly generates a quantity of position moves associated with the player symbol, and for each of the quantity of position moves associated with the player symbol, enables a player to input a direction of movement. For each of the participant symbols, the gaming system of this embodiment, determines a quantity of position moves, and for each of the quantity of position moves associated with the participant symbol, determines a direction of movement. The gaming system also determines a movement order for each of the player symbol and the at least one participant symbol and displays the player symbol and the at least one participant symbol each moving to a separate one of the outcome positions, wherein: the outcome position the player symbol is moved to is based, at least in part, on the player inputted direction of movement, for each participant symbol, and the outcome position the participant symbol is moved to is based, at least in part, on the determined direction of movement for the participant symbol. If the inputted directed of movement for the quantity of positions moves associated with the player symbol corresponds to one of the outcome positions and the determined direction of movement for the quantity of position moves associated with one of the participant symbols corresponds to the same outcome position, the gaming system displays one of the player symbol and the participant symbol at the outcome position, and displays the other one of the player symbol and the participant symbol at another one of the outcome positions, wherein which of the player symbol and the participant symbol is displayed at which of the outcome positions is based on the determined movement order. Additionally, the gaming system of this embodiment provides the player the outcome associated with the moved to outcome position of the player symbol.

In another embodiment, the gaming system disclosed herein displays a matrix including a plurality of different positions, a plurality of the positions each being associated with one of a plurality of different outcomes, and displays a player symbol at one of the different positions, and at least one participant symbol at least one of the different positions. The gaming system of this embodiment randomly generates a quantity of position moves associated with the player symbol, determines a plurality of the positions available for the player symbol to move to, the determination based on the position the player symbol is displayed at and the generated quantity of position moves, and enables a player to designate one of the determined plurality of the positions available for the player symbol to move to as a player destination position. In this embodiment, for each participant symbol, the gaming system determines a quantity of position moves, and designates one of the positions to move to as a participant destination position, the designation based on the position the participant symbol is displayed at and the determined quantity of position moves for the participant symbol. The gaming system of this embodiment also determines a movement order for the player symbol and the at least one participant symbol, displays at least one of the player symbol and the at least one participant symbol moving to at least one of the designated destination positions, wherein if the designated player destination position is the same position as one of the designated participant destination positions: one of the player symbol and the participant symbol is displayed at the designated destination position, and the other one of the player symbol and the participant symbol is displayed at another one of the positions, wherein which of the player symbol and the participant symbol is displayed at the designated position is based on the determined movement order and provides the player the outcome associated with the moved to position of the player symbol.

In another embodiment, the gaming system disclosed herein displays: a matrix including a plurality of positions, a plurality of the positions each associated with one of a plurality of different outcomes, a player symbol at a current one of the positions, and at least one participant symbol at a separate current one of the positions. For the player symbol, the gaming system randomly generates a quantity of position moves, and for each of the generated quantity of position moves, enables a player to input a direction of movement. For each participant symbol, the gaming system determines a quantity of positions moves, and for each of the quantity of position moves associated with the participant symbol, determines a direction of movement. The gaming system of this embodiment determines a movement order for the player symbol and the at least one participant symbol, displays the player symbol moving to one of the positions, wherein the position the player symbol is moved to is based on at least a plurality of: the current position of the player symbol, the player inputted direction of movement and the determined movement order, displays each participant symbol moving to a separate one of the positions, wherein the position each participant symbol is moved to is based on at least a plurality of: the current position of the participant symbol, the determined direction of movement for the participant symbol and the determined movement order, and repeats this process at least once and until a terminating event occurs.

Accordingly, the gaming system disclosed herein provides a multi-player or multi-participant movement game (such as a racing game) wherein during an initial time period, all players input a destination position for their respective racers and after this initial time period, the gaming system determines which racers are moved to their inputted destination positions and which racers block other racers and cause the other racers to move to alternative, non-inputted destination positions. Such configuration thus provides a multi-participant community game wherein each participant's decisions regarding how to play the community game affect not only the play of the community game for that participant, but may also affect the play of the community game for one or more other participants and thus affect the outcomes provided to one or more other participants.

Additional features and advantages are described herein, and will be apparent from the following Detailed Description and the figures.

BRIEF DESCRIPTION OF THE FIGURES

FIG. 5 is a front view of a display of one embodiment of the gaming system disclosed herein illustrating the information displayed to an individual participant regarding a play of the community trail game.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
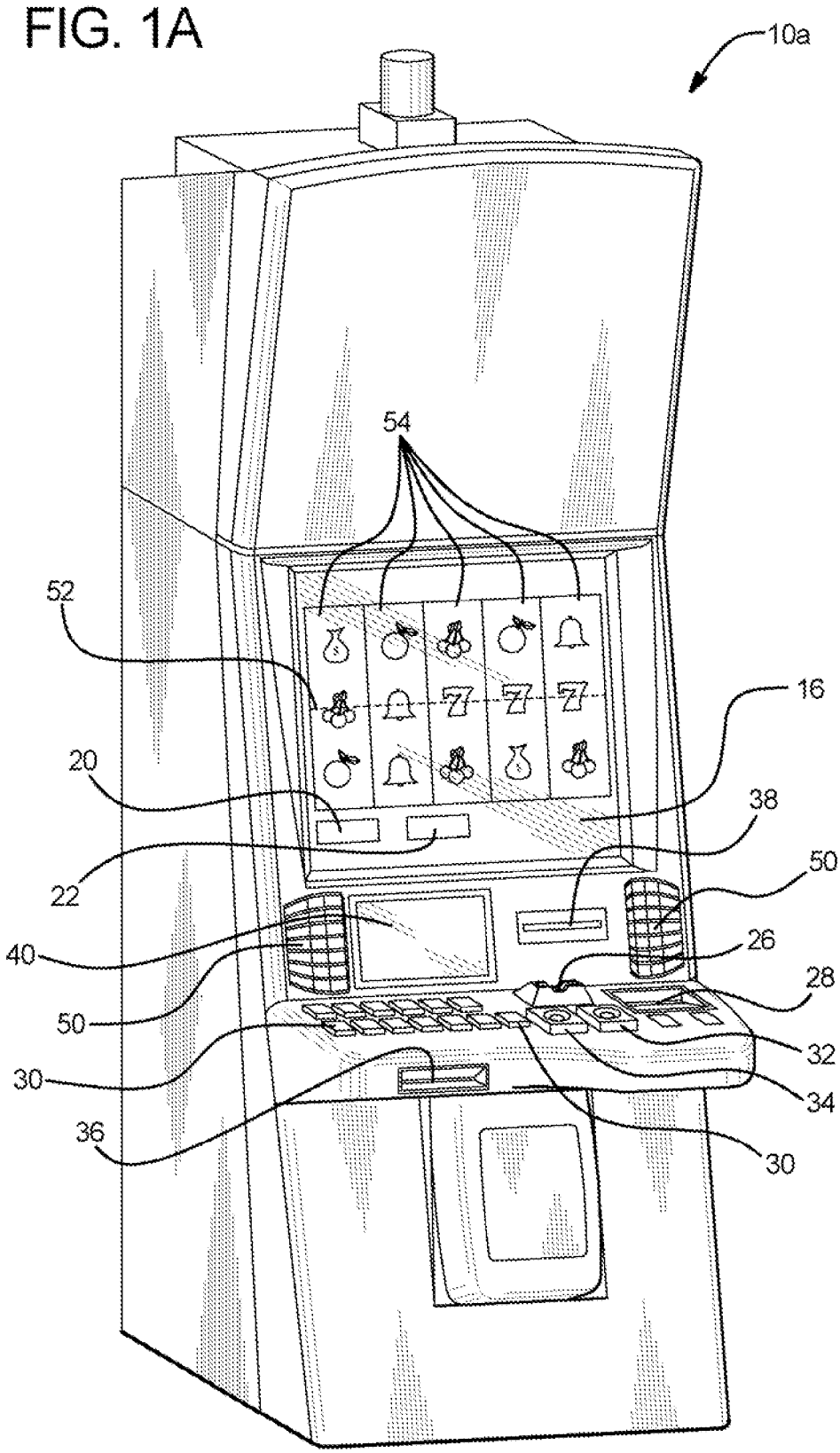
FIGS. 1A and 1B are front perspective views of alternative embodiments of gaming devices disclosed herein.
Figure 1B:
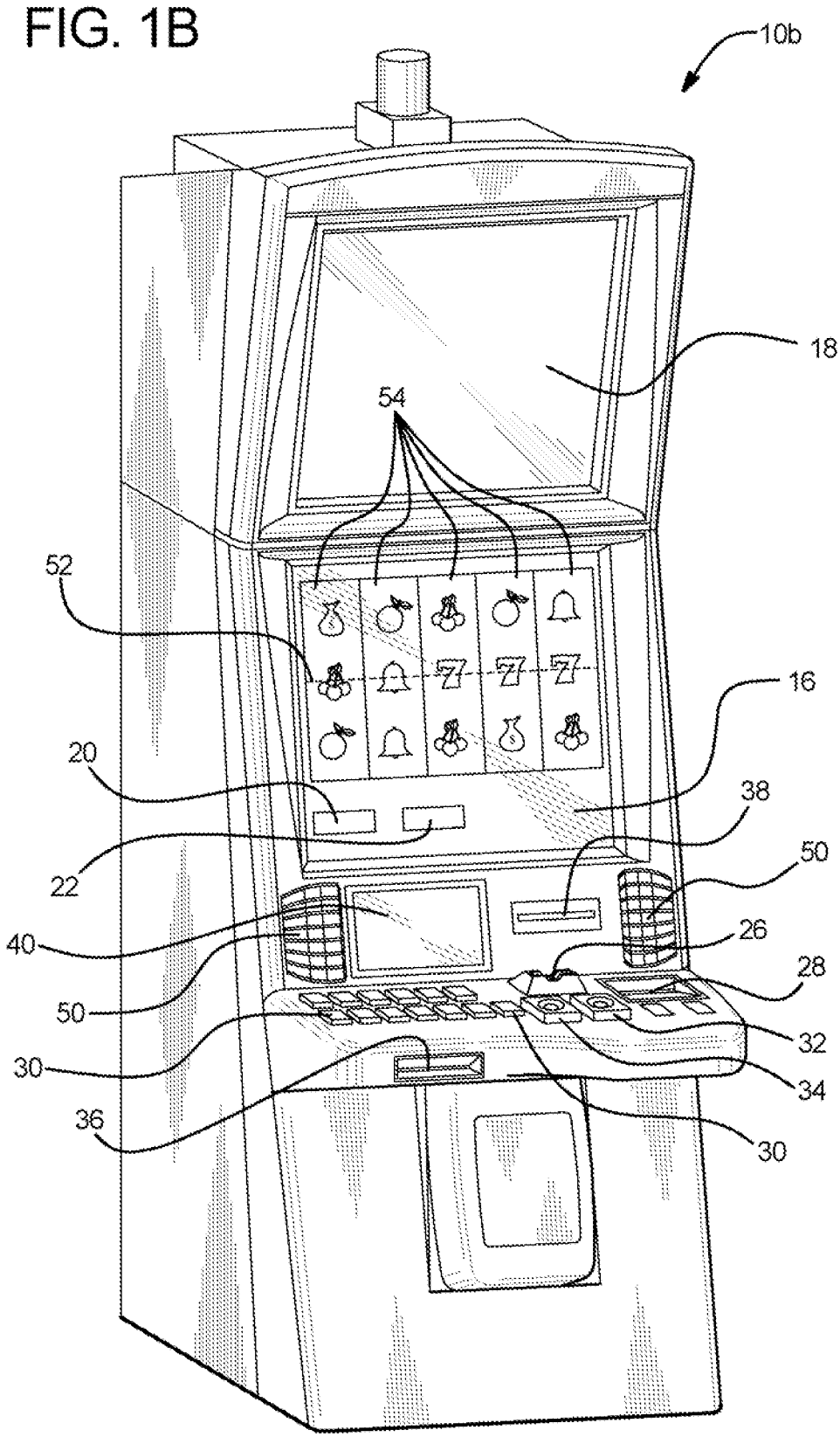

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
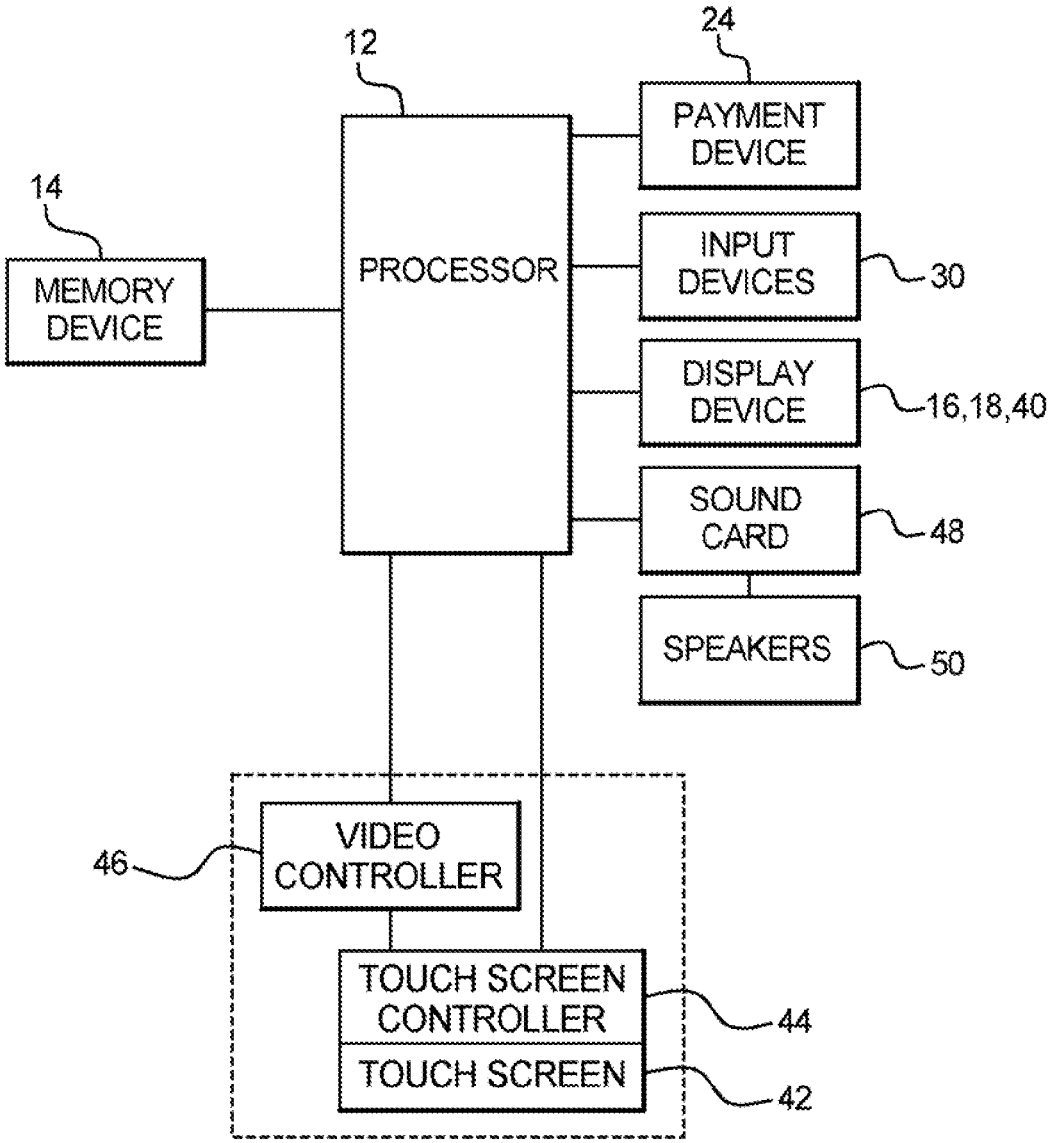
FIG. 2A is a schematic block diagram of the electronic configuration of one embodiment of a gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a hand-held device, such as a personal digital assistant (PDA), a portable computing or mobile device, or another computerized platform to implement the present disclosure. In one embodiment, the gaming device or gaming machine disclosed herein is operable over a wireless network, for example as part of a wireless gaming system. In one such embodiment, the gaming machine may be a hand-held device, a mobile device, or any other suitable wireless device that enables a player to play any suitable game at a variety of different locations. In various embodiments in which the gaming device or gaming machine is a hand-held device, a mobile device, or any other suitable wireless device, at least one memory device and at least one processor which control the game or other operations of the hand-held device, mobile device, or other suitable wireless device may be located: (a) at the hand-held device, mobile device or other suitable wireless device; (b) at a central server or central controller; or (c) any suitable combination of the central server or central controller and the hand-held device, mobile device or other suitable wireless device. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as discussed in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as discussed in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as discussed above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown)

which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as discussed above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as discussed above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more than one or all of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as discussed above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as discussed above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as discussed above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
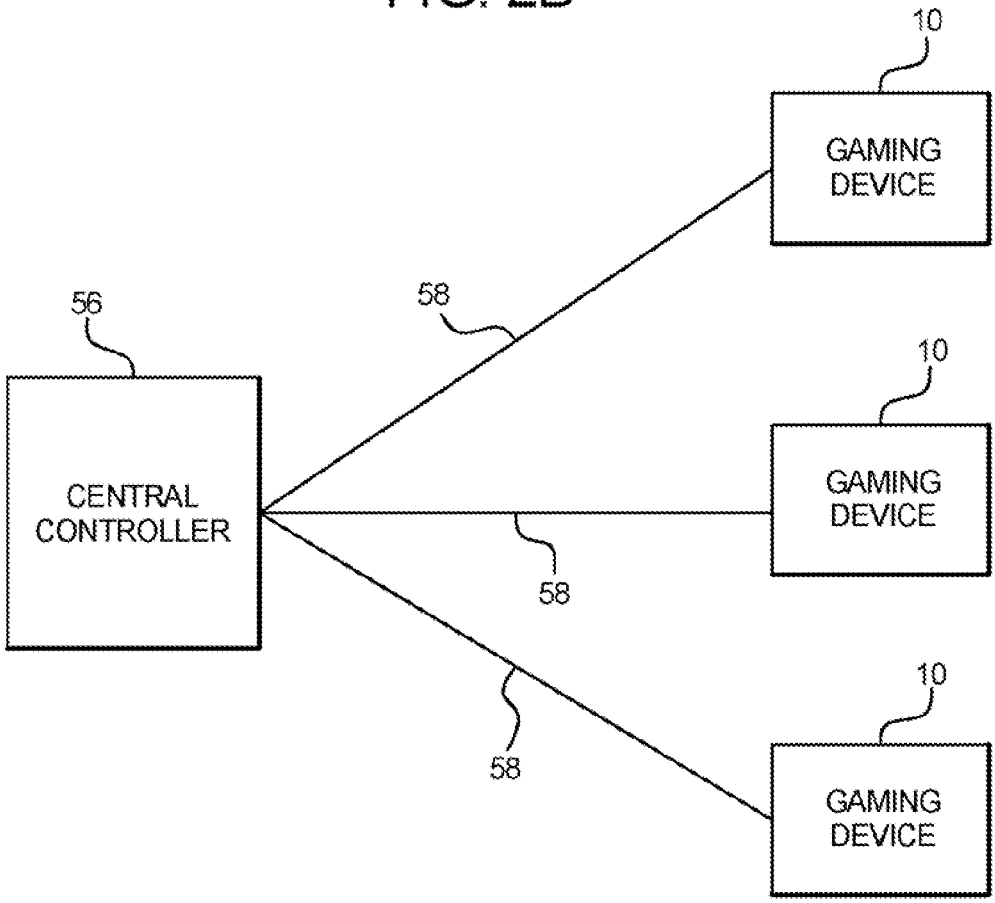
FIG. 2B is a schematic diagram of the central server in communication with a plurality of gaming devices in accordance with one embodiment of the gaming system disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As discussed above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as discussed above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as discussed above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as discussed above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as discussed above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices. In these embodiments, the play of the group or community game is displayed on one or more community displays (or via a service window for internet based participants in the group or community game).

Community Trail Game

Figure 3:
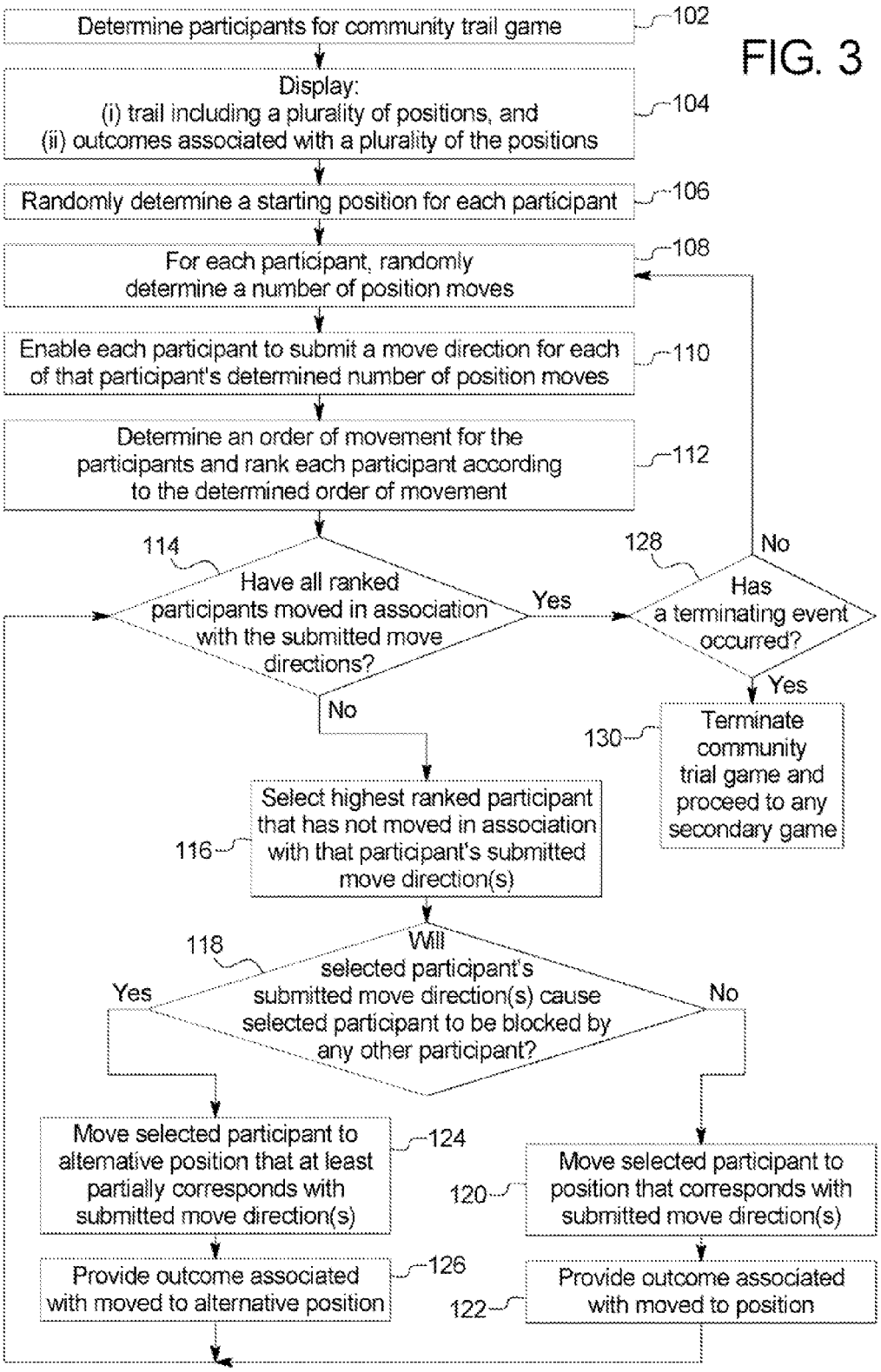
FIG. 3 is a flowchart illustrating a method of one embodiment of the gaming system disclosed herein and illustrating a plurality of participants playing a community trail game.

Referring now to FIG. 3, a flowchart of an example embodiment of a process for operating a gaming system or a gaming device disclosed herein is illustrated. In one embodiment, this process is embodied in one or more software programs stored in one or more memories and executed by one or more processors or servers. Although this process is described with reference to the flowchart illustrated in FIG. 3, it should be appreciated that many other methods of performing the acts associated with this process may be used. For example, the order of certain steps described may be changed, or certain steps described may be optional.

In operation of this illustrated embodiment, the gaming system determines the participants for a community trail game as indicated in block 102. In various embodiments, the participants for the community trail game include one or more of: (i) players playing gaming devices at a gaming establishment, (ii) players playing wagering games online or via a mobile device, (iii) players playing non-wagering games online or via a mobile device, (iv) internet gaming bots programmed to play the community trail game based on one or more player's previous plays of the community trail game, and/or (v) internet gaming bots programmed to play the community trail game (independent of any player's previous plays of the community trail game).

After determining which participants will compete in the community game, as indicated in block 104, the gaming system causes at least one display device to display a trail including a plurality of positions. As also indicated in block 104, the gaming system causes at least one display device to display a plurality of outcomes associated with a plurality of the positions. In various embodiments, the outcomes associated with the plurality of the positions include, but are not limited to: credits, quantities of free spins, multipliers, picks of selections, accumulators, anti-blockers, progressive awards, physical prizes, free spin upgrades (such as additional wild symbols), player status upgrades (such as leveling-up to a next achievement level), entry for a future automated drawing, entry for a live-action drawing, and position move modifiers (such as position move incrementors and position move decrementors).

As indicated in block 106, the gaming system randomly determines a starting position for each participant. In addition to randomly determining a starting position for each participant, the gaming system randomly determines a number of position moves for each participant as indicated in block 108. Each position move represents a participant's ability to move one position along the trail.

After determining the number of position moves for each participant, the gaming system then simultaneously (or substantially simultaneously) enables each participant to submit a move direction for each of that participant's determined number of position moves as indicated in block 110. The move directions the participant inputs correspond to a destination position which that participant would like to move to along the trail. In one embodiment, the gaming system displays the number of position moves each individual player is enabled to make only to that individual player. This embodiment includes an additional element of strategy or skill as each player surveys the current positions of the other participants of the community trail game and assesses, based on different probabilities of obtaining different numbers of position moves, the likelihood of other participants attempting to move to the same position as that participant. It should be appreciated that since the outcomes associated with certain of the positions are displayed, each participant is aware of the outcome they would be provided (if that participant is actually moved to the position that corresponds with the participant submitted move direction(s)). This configuration provides players with an increased level of control or influence in how they participate in the community trail game.

After enabling each participant to submit a move direction for each of that participant's determined number of position moves, the gaming system determines an order of movement for the participants and ranks each participant (or participant move) according to the determined order of movement as indicated in block 112 of FIG. 3. In one embodiment, the gaming system determines an order of movement based on each participant's current position relative to one or more other positions of the trail. In one such embodiment, the gaming system determines that the participant that has moved a furthest distance along the trail is the highest ranked participant, the participant that has moved the next furthest distance along the trail is the next highest ranked participant and so on. In one embodiment, if a tie occurs in the determined order of movement, the gaming system employs a secondary determination to determine the order of movement and thus rank each participant. In one such embodiment, if the gaming system determines that at least two participants have each moved an equal distance along the trail, the gaming system determines that the participant closest to a designated position or group of positions, such as the participant closest to an inside lane of the trail, is the higher ranked participant.

After determining the rank of each participant (or participant move), the gaming system determines if each ranked participant has moved in association with the submitted move directions as indicated in diamond 114. If at least one ranked participant has not moved in association with the submitted move directions, the gaming system selects the highest ranked participant that has not moved in association with the submitted move directions as indicated in block 116.

After selecting the highest ranked participant that has not yet moved, the gaming system determines if the selected participant's submitted move direction (or move directions if the participant submitted multiple different directions) will cause the selected participant to be blocked by any other participant as indicated in diamond 118 of FIG. 3. That is, the gaming system determines if the selected participant has a free and clear path along the submitted move direction(s) or if one or more other participants are already situated along the path and thus would block the selected participant's movement(s).

If the gaming system determines that the submitted move direction for the selected highest ranked participant that has not yet moved will not be blocked by another participant, the gaming system moves the selected participant to a position that corresponds with the submitted move direction as indicated in block 120. The gaming system then provides the outcome associated with the moved to position as indicated in block 122.

After moving the selected participant and providing the outcome associated with the moved to position, the gaming system returns to the decision indicated by diamond 114 and again determines if each ranked participant has moved in association with the submitted move directions.

On the other hand, if the gaming system determines that the submitted move direction for the selected highest ranked participant that has not yet moved will be blocked by another participant, the gaming system moves the selected participant to an alternative position that at least in part corresponds with the submitted move direction as indicated in block 124. The gaming system then provides the outcome associated with the moved to alternative position as indicated in block 126. That is, if the gaming system determines that another participant's position along the trail will block or otherwise prevent a participant from moving to an inputted destination position, the gaming system moves the blocked participant to another, alternative position along the trail. After moving the selected participant to an alternative position and providing the outcome associated with the resulting or moved to alternative position, the gaming system returns to the decision indicated by diamond 114 of FIG. 3 and again determines if each ranked participant has moved in association with the submitted move directions.

If at least one ranked participant has not moved in association with the submitted move directions for the current set of movements, the gaming system selects the highest ranked participant that has not moved in association with the submitted move directions and proceeds as described above.

On the other hand, if each ranked participant has moved in association with the submitted move directions for the current set of movements, the gaming system determines if a terminating event has occurred as indicated in diamond 128 of FIG. 3. In one embodiment, the community bonus game includes a plurality of rounds (with each round including a movement of each participant) and the terminating event occurs when the final round is complete.

If the gaming system determines that the terminating event has not occurred, the gaming system returns to block 108, randomly determines a number of position moves for each participant and proceeds as described above. On the other hand, if the gaming system determines that the terminating event has occurred, the gaming system terminates the community trail game and proceeds to any secondary game as indicated in block 130.

It should be appreciated that any suitable secondary game, either related to or independent from the community trail game, may be employed in accordance with the present disclosure. In one embodiment, the secondary game is a free activation or spin game in which one or more outcomes accumulated during the community trail game determine the quantity of free activations or spins and the modifier, such as a multiplier to apply to one or more of the free activations or spins.

Figure 4A:
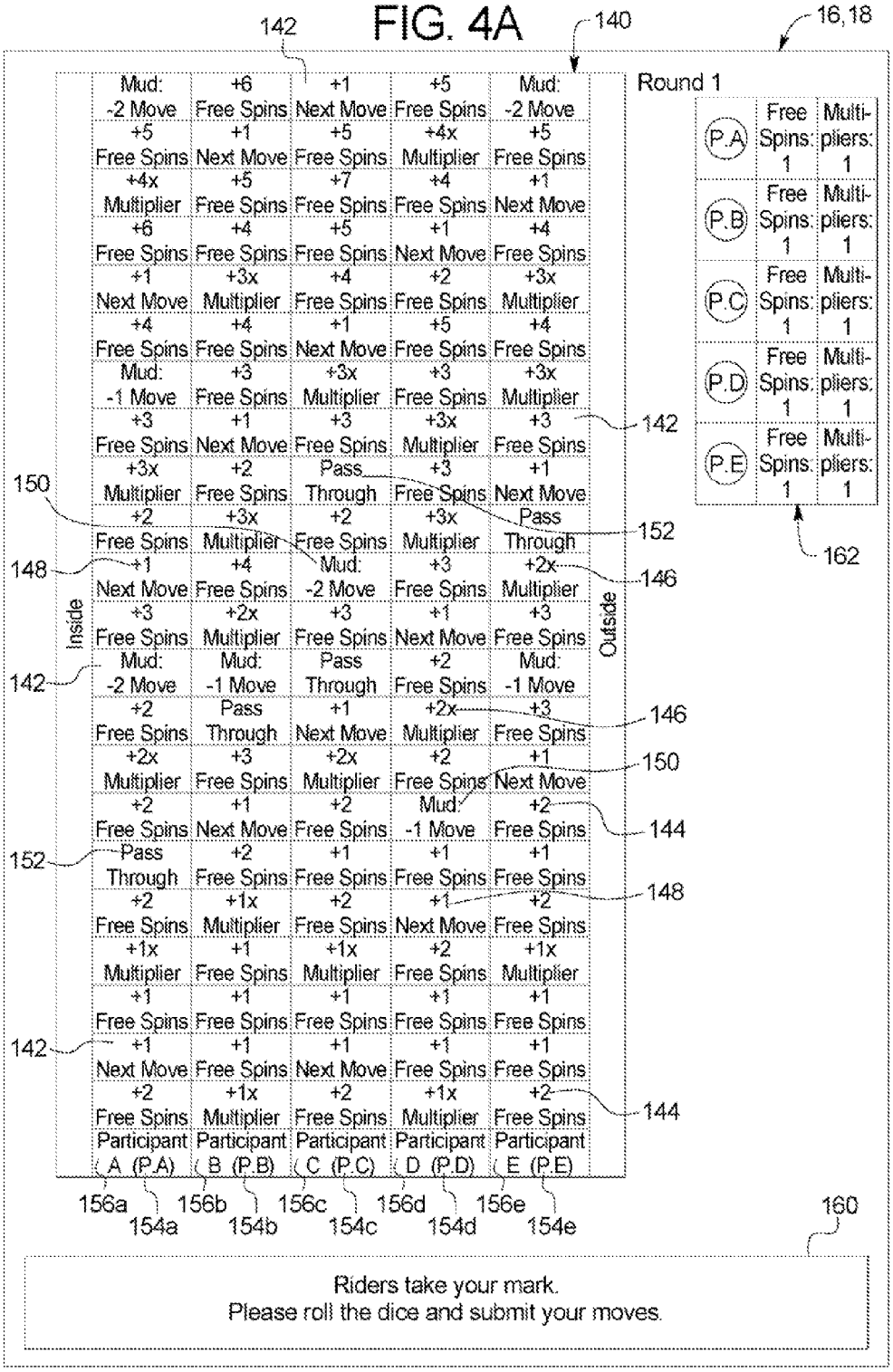
FIGS. 4A, 4B, 4C, 4D, 4E, 4F, 4G, 4H, 4I, 4J, 4K, 4L, 4M, 4N, 40, 4P, 4Q, 4R, 4S, 4T, 4U, 4V, 4W, 4X, 4Y, 4Z and 4AA are front views of a display of one embodiment of the gaming system disclosed herein illustrating a plurality of participants each participating in a community trail game.

Turning now to FIGS. 4A to 4AA, an example of a multi-round community trail game of one embodiment of the gaming system disclosed herein is illustrated. In this example, as seen in FIG. 4A, the gaming system displays a trail, path or matrix 140 including a plurality of positions 142. In this illustrated example, the outcomes associated with the plurality of the positions include quantities of free spins 144, multipliers 146, position move modifiers, (such as position move incrementors 148 and position move decrementors) 150 and anti-blockers 152.

In this example, as also illustrated in FIG. 4A, for a first round of play, the gaming system randomly determined that Participant A (displayed as participant symbol P.A.) 154*a* will start at a first starting position (relative to an inside of the trail) 156*a*, Participant B (displayed as participant symbol P.B.) 154*b* will start at a second starting position (relative to the inside of the trail) 156*b*, Participant C (displayed as participant symbol P.C) 154*c* will start at a third starting position (relative to the inside of the trail) 156*c*, Participant D (displayed as participant symbol P.D.) 154*d* will start at a fourth starting position (relative to the inside of the trail) 156*d*, and Participant E (displayed as participant symbol P.E.) 154*e* will start at a fifth starting position (relative to the inside of the trail) 156*e*.

In this example, before moving any of the participants along the trail for the current round of the community trail game, the gaming system: (i) randomly determines a number of position moves for each participant (such as by using a roll of a die), and (ii) enables each participant to submit how that participant wants their position moves used. It should be appreciated that enabling each participant to submit their position moves before any of the participants move for the current round provides an increased level of excitement and entertainment for the participants.

Figure 4B:
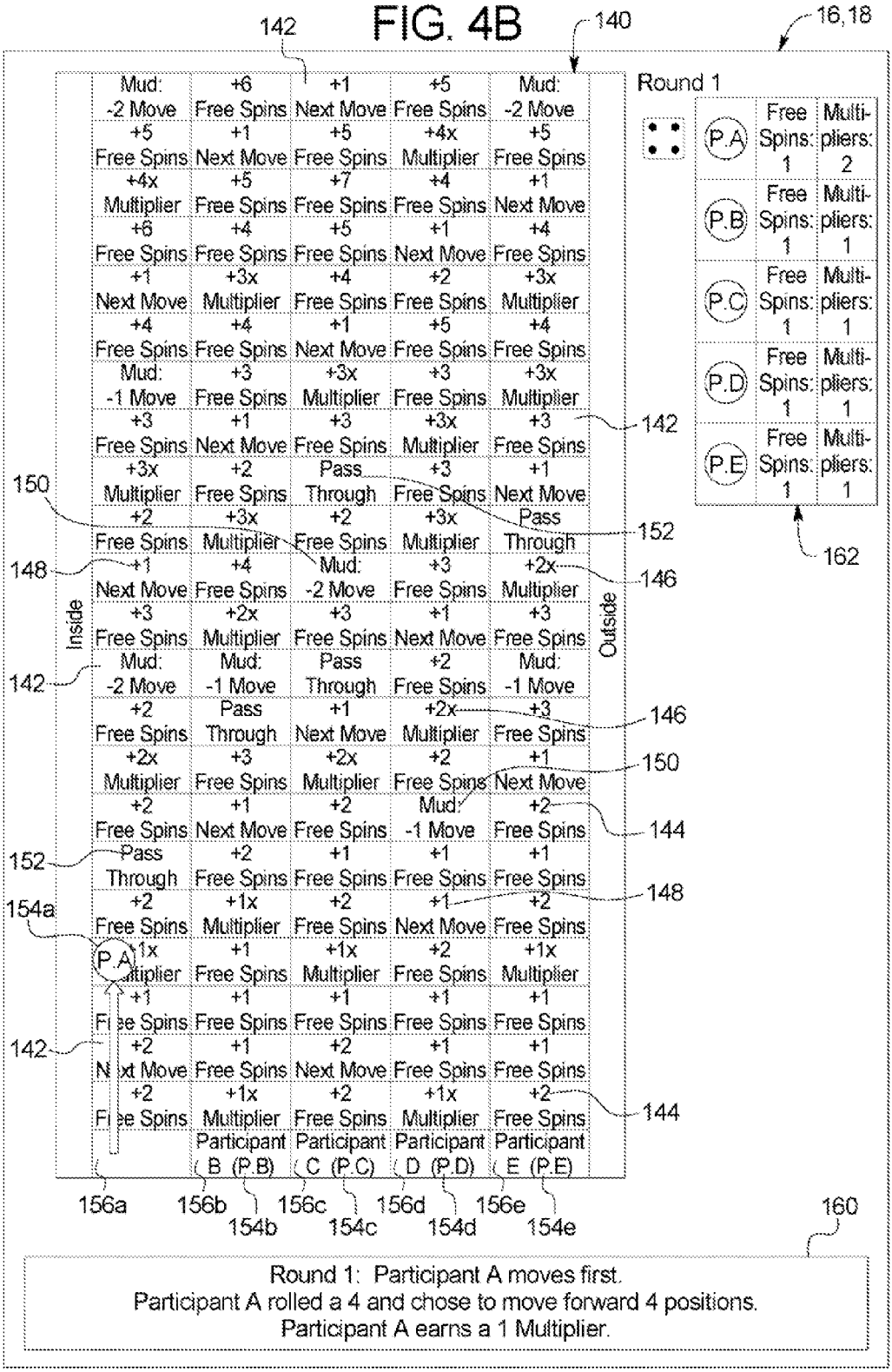

It should be further appreciated that while the gaming system simultaneously displays the trail or path of FIG. 4A to each of the participants, in one embodiment, the gaming system also displays additional information regarding the trail or path to the individual participants of the community trail game. For example, FIG. 5 illustrates the information displayed to Participant A in association with Participant A selecting how to play the current round of the community trail game. As seen in FIGS. 4B and 5, the gaming system randomly determines that Participant A is provided four position moves based on the result of the roll of the die. In this example, since Participant A is permitted four position moves, the gaming system enables Participant A to select how to utilize the provided position moves. That is, as seen in FIG. 5, the gaming system displays to Participant A the different options available for the determined four position moves and enables Participant A to select or designate which of the positions to move to based on the provided position moves and the current position of Participant A. In this example, the gaming system displays to the player visually, or through suitable audio or audiovisual displays, appropriate messages such as "You can move four positions" and "Would you like to move: 1. Four positions forward to the position associated with a +1× Multiplier; 2. Three positions forward and one position to the right to the position associated with a +1 Free Spin; 3. Two positions forward and two positions to the right to the position associated with a +1 Next Move; or 4. One position forward and three positions to the right to the position associated with the +1× Multiplier."

After enabling each participant to simultaneously submit a move direction for each of that participant's determined number of position moves, the gaming system determines a order of movement for the participants and ranks each participant according to the determined order of movement. As seen in FIG. 4B, in this example, the gaming system determines that since each of the participants have moved the same distance along the path (i.e., each of the participants are at a starting position), Participant A is closest to the designated group of positions that form the inside lane of the trail and thus Participant A is selected as the highest ranked participant that has not yet moved. Accordingly, upon determining that based on the submitted move direction of moving four positions forward, Participant A has a free or unencumbered path to the position associated with a 1× multiplier, the gaming system moves Participant A to the position associated with a 1× multiplier and provides or otherwise accumulates a 1× multiplier for Participant A.

The gaming system next determines that Participant B is closest to the designated group of positions that form the inside lane of the trail, selects Participant B as the highest ranked participant that has not yet moved and proceeds with moving Participant B based on the submitted move directions for Participant B. As seen in FIGS. 4C to 4F, each of Participant B to Participant E have a free path to their respective designated positions (determined based on each participant's submitted move directions) and the gaming system moves each of Participants B to E along the trail accordingly. Specifically, the gaming system: moves Participant B six moves forward along the trail to the position associated with two additional free spins and provides or otherwise accumulates two free spins for Participant B; moves Participant C one move forward along the trail to the position associated with two additional free spins and provides or otherwise accumulates two free spins for Participant C; moves Participant D four moves forward along the trail to the position associated with two additional free spins and provides or otherwise accumulates two free spins for Participant D; and moves Participant E three moves forward along the trail to the position associated with one additional free spin and provides or otherwise accumulates one free spin for Participant E.

Figure 4C:
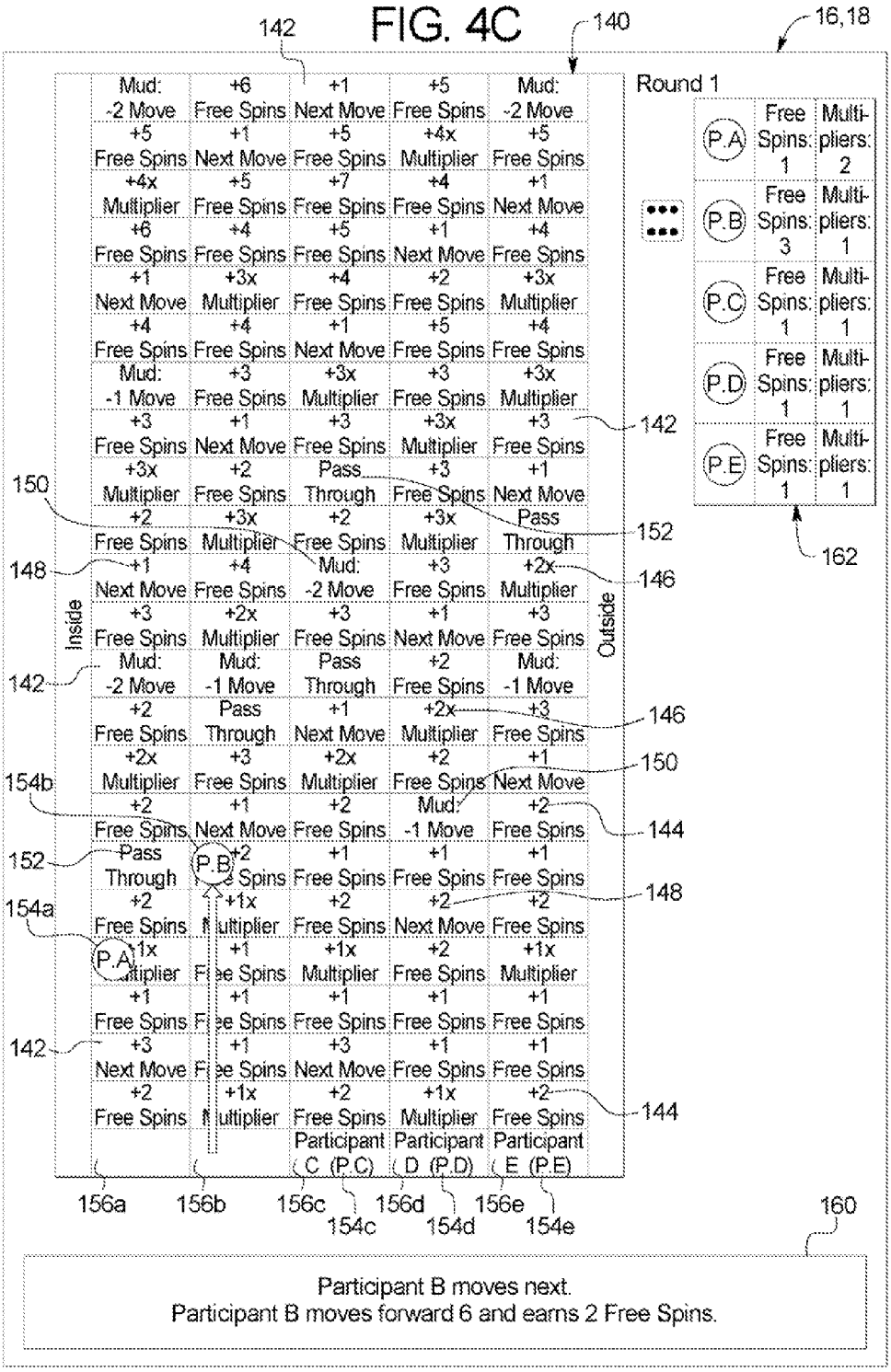
Figure 4D:
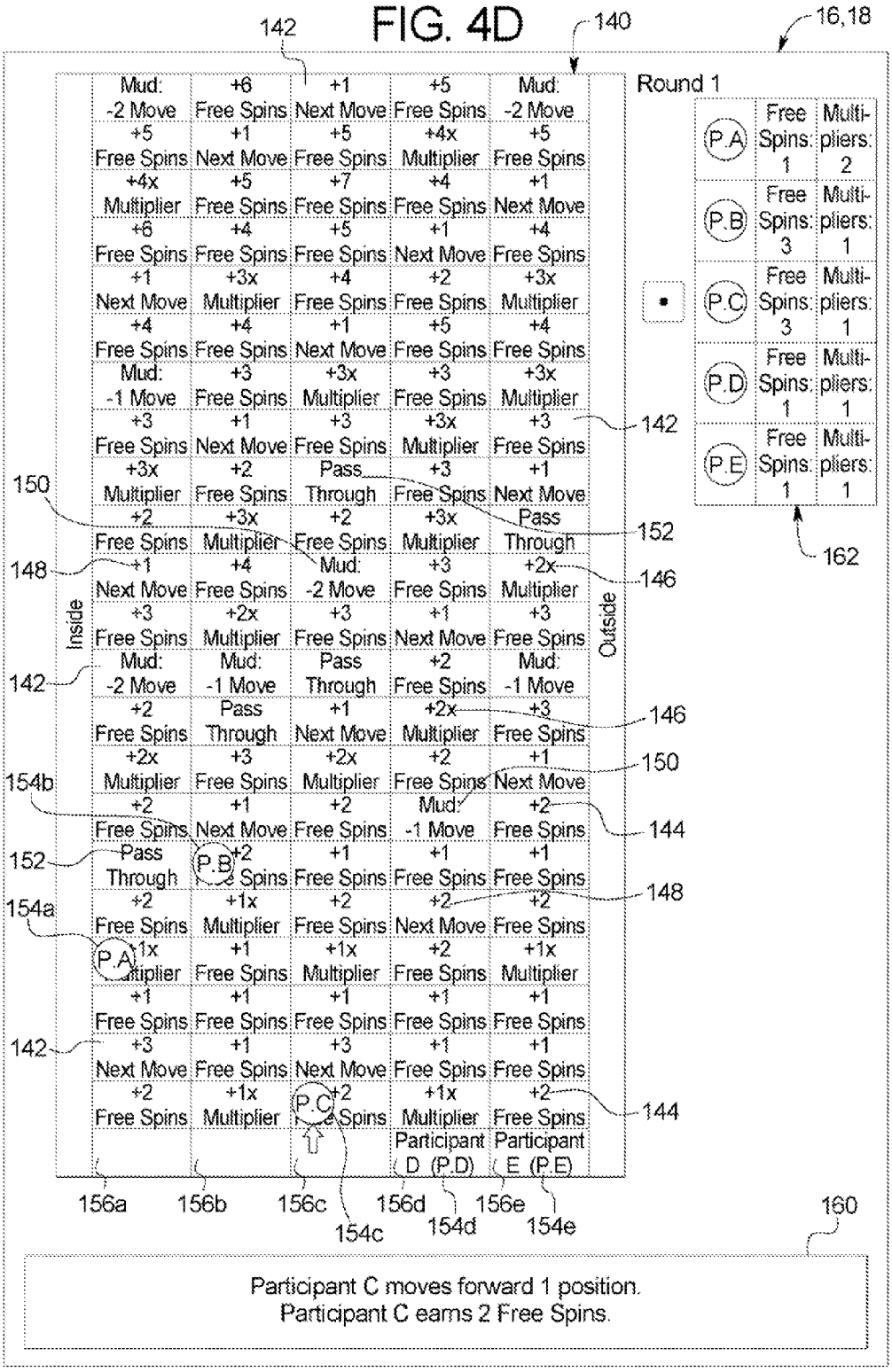
Figure 4E:
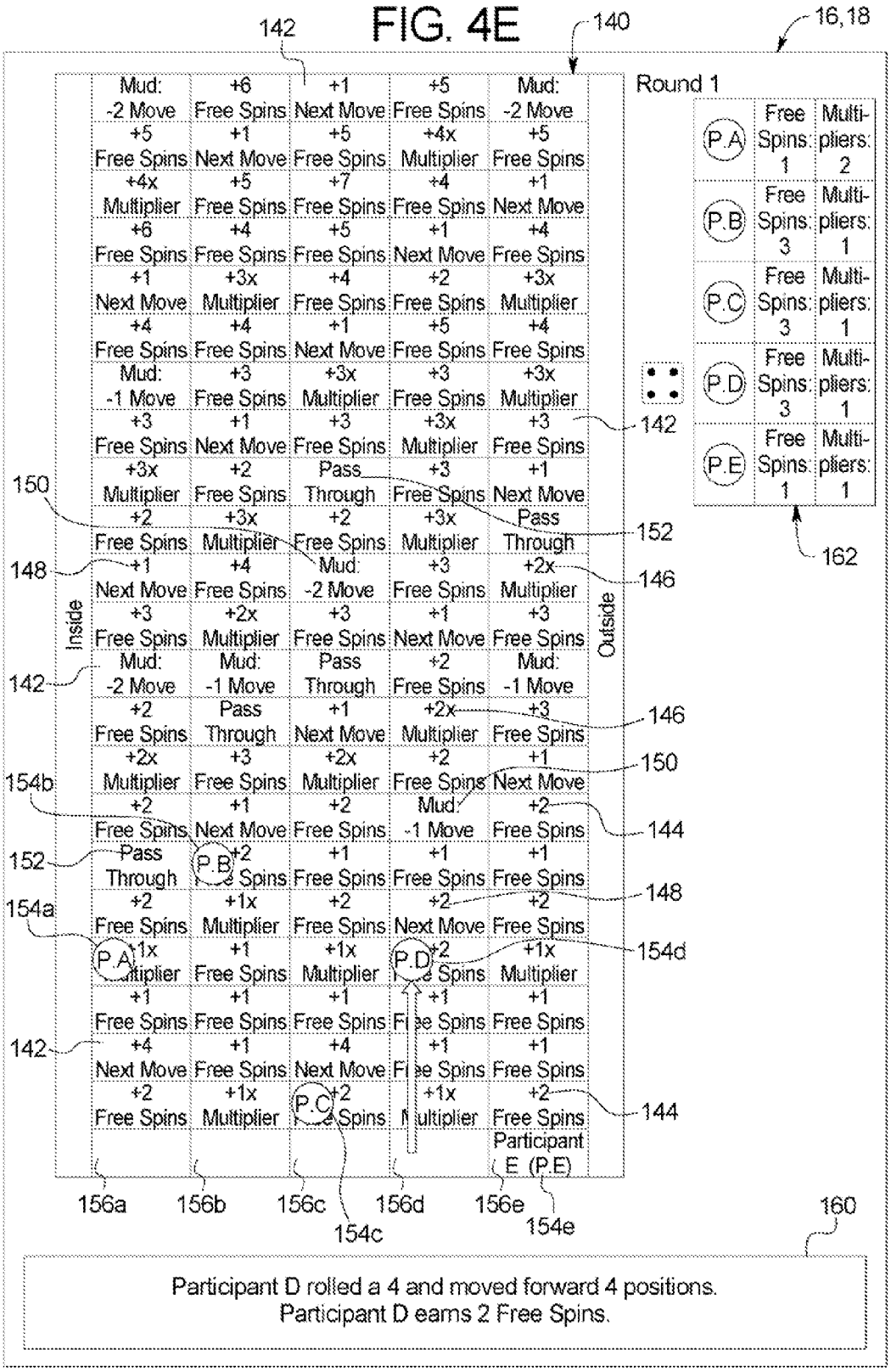
Figure 4F:
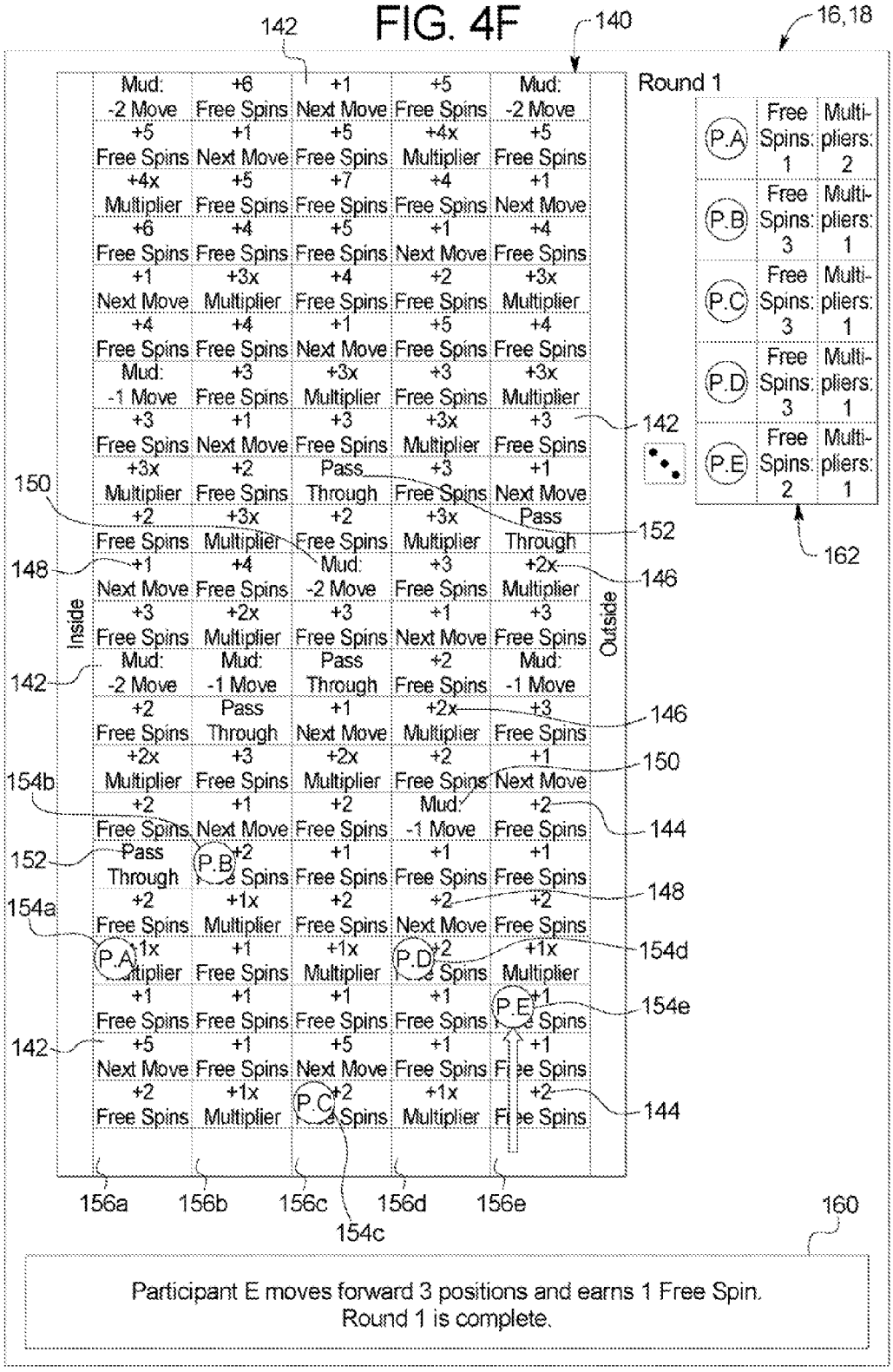

In one embodiment, the quantity of additional moves associated with one or more of the move incrementors increase during the play of the community game. In this embodiment, each time a participant passes a move incrementor (regardless of if that participant passes over the position associated with the move incrementor), the number of additional moves associated with that move incrementor increases. For example, as seen in FIGS. 4B to 4C, when Participant B moved passed the position associated with the move incrementor of "+1 Next Move", the gaming system modified that move incrementor to "+2 Next Move".

Figure 4G:
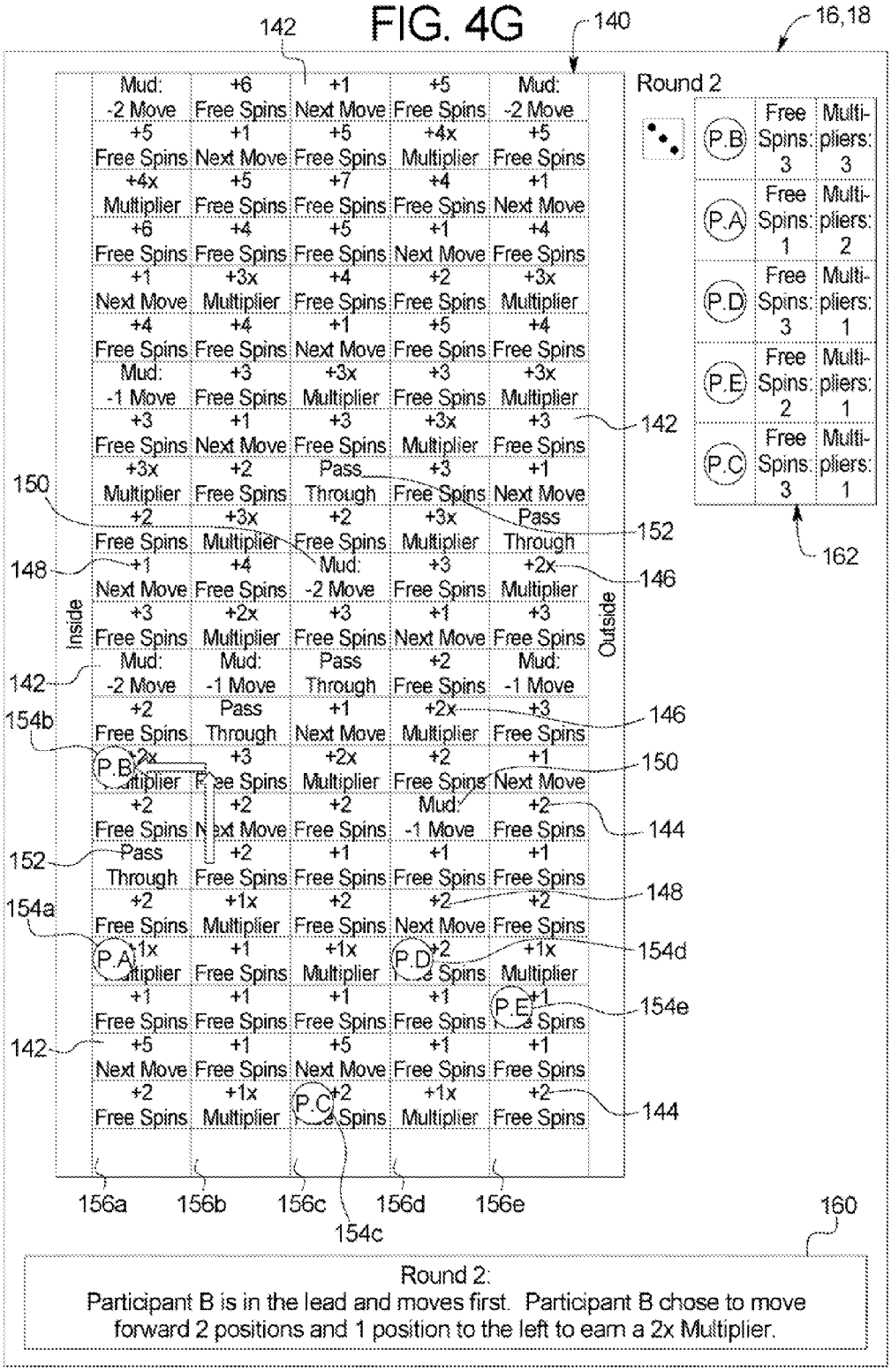

In this illustrated example, since each of the participants have moved along the trail for the current round, the first round is complete and the gaming system advances to the second round. As described above, for the second round, before moving any of the participants along the trail for this second round of the community trail game, the gaming system randomly determines a number of position moves for each participant, enables each participant to submit how they want their position moves used and determines an order of movement for the participants. In this example, as seen in FIG. 4G, since Participant B is in the lead (i.e., has advanced the furthest distance along the trail), Participant B moves first. Accordingly, the gaming system moves Participant B two moves forward and one move to the left along the trail to the position associated with a 2× multiplier and provides or otherwise accumulates a 2× multiplier for Participant B.

Figure 4H:
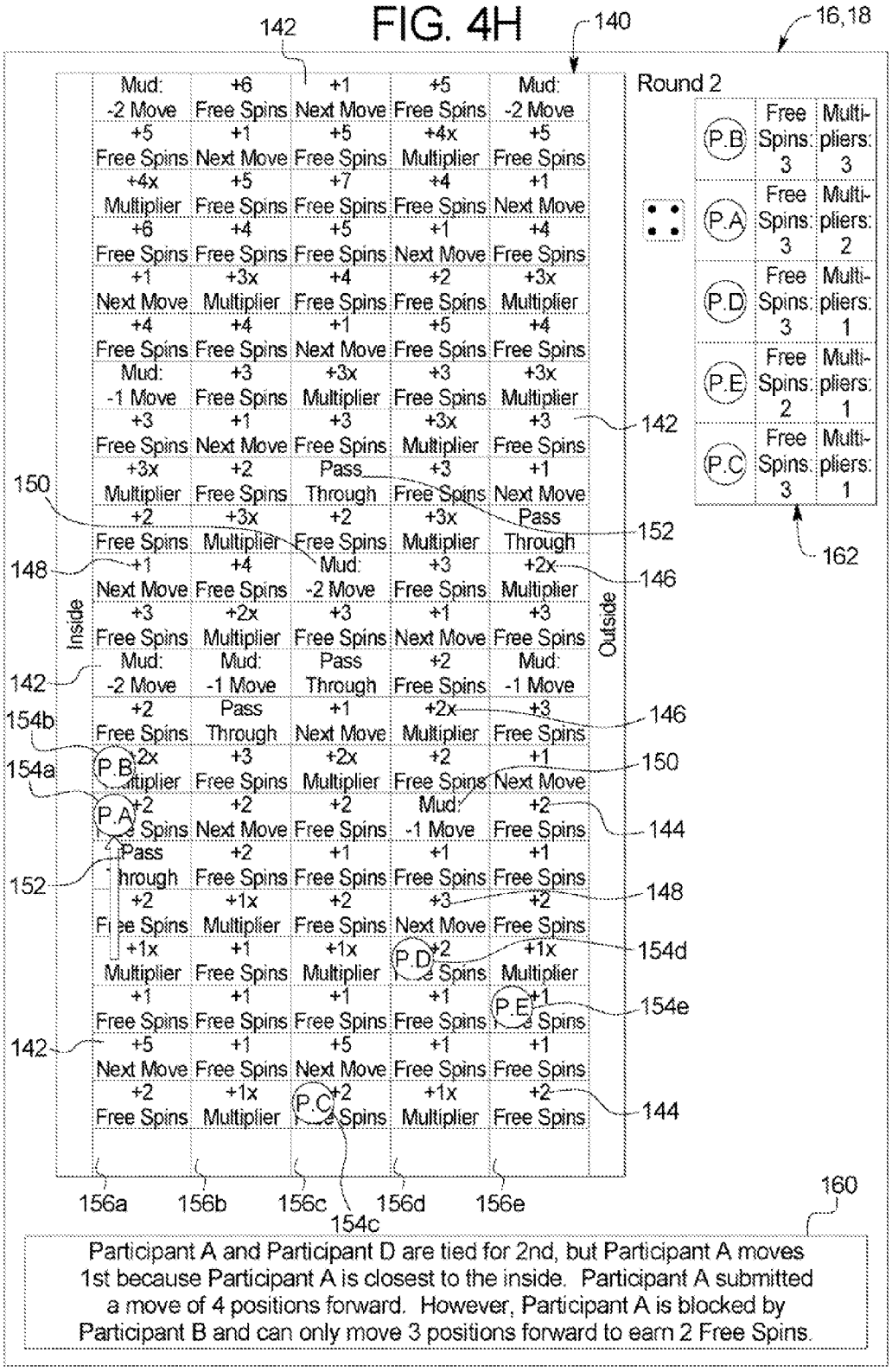

As seen in FIG. 4H, after determining that Participant A and Participant D are tied for second place (i.e., the highest ranked participants that have not yet moved for this round), the gaming system determines Participant A is closest to the inside lane of the trail and thus Participant A moves next. In this example, the gaming system determines that, based on the submitted move direction of moving four positions forward, Participant A has a blocked path to the submitted destination position associated with a 2× multiplier. That is, Participant B moved before Participant A and is currently located at the submitted destination position associated with a 2× multiplier. Accordingly, the gaming system moves Participant A to the alternative position associated with two free spins and provides or otherwise accumulates two free spins for Participant A. It should be appreciated that because the gaming system moved Participant B before Participant A (based on the determined ranking of the participants) and Participant B blocked the designated path of Participant A, the outcome provided to Participant A for this round or turn of moves is affected by or otherwise influenced by the decisions of Participant B.

Figure 4I:
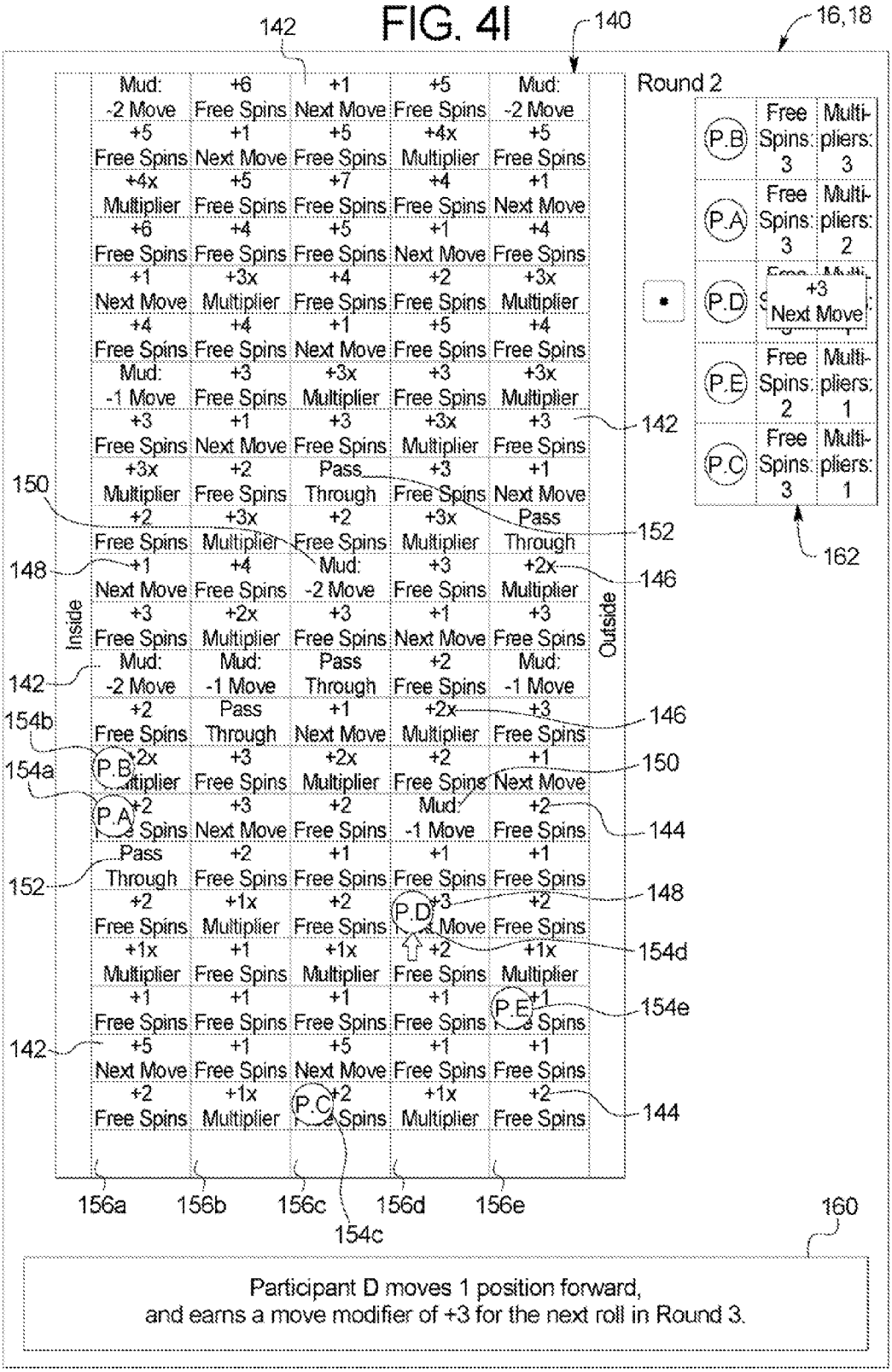

As seen in FIG. 4I, the gaming system determines that Participant D (i.e., the determined next participant to move according to the determined order of movement) has a free path and thus the gaming system moves Participant D one move forward along the trail to the position associated with the move incrementor of three additional moves on Participant D's next turn.

Figure 4J:
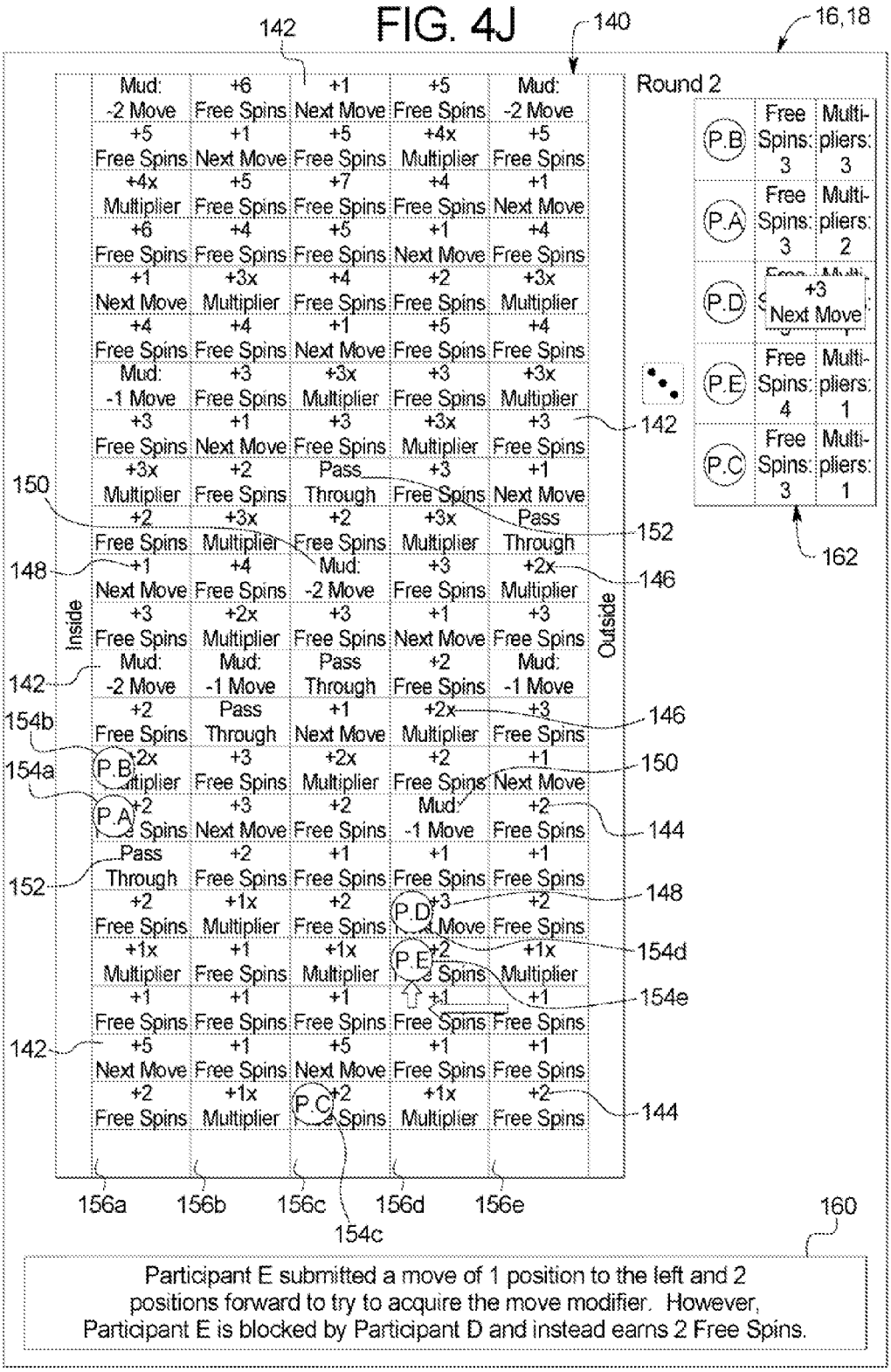

Turning now to FIG. 4J, the gaming system determines that, based on the submitted move directions of moving one position to the left and two positions forward, Participant E has a blocked path to the position associated with the move incrementor of three additional moves. That is, since Participant D arrived at that position before Participant E, Participant D is blocking Participant D's submitted move. Accordingly, the gaming system moves Participant D to the alternative position associated with two free spins and provides or otherwise accumulates two free spins for Participant D.

Figure 4K:
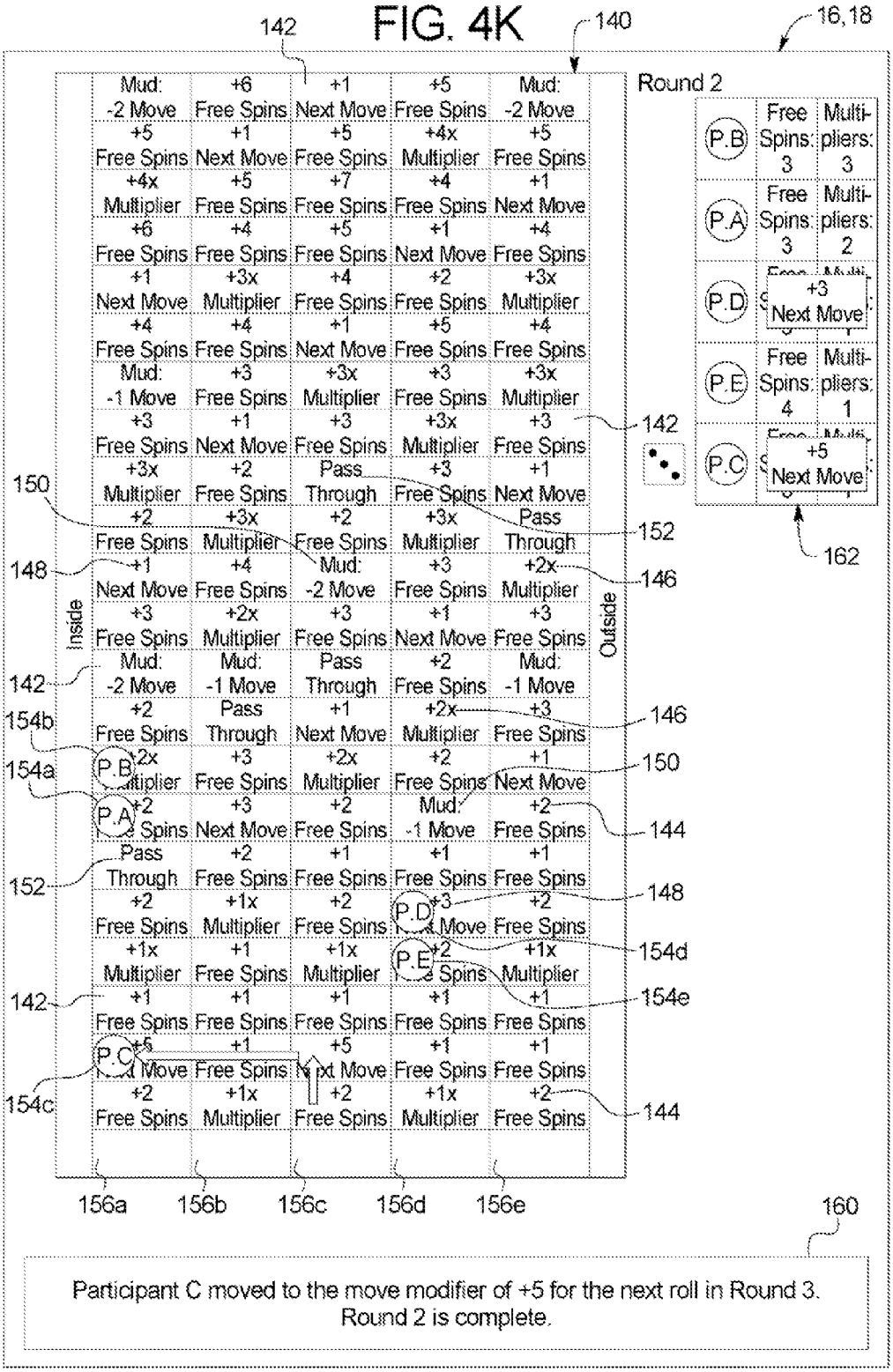

As seen in FIG. 4K, the gaming system determines that Participant C (i.e., the determined next participant to move according to the determined order of movement) has a free path and thus the gaming system moves Participant C two moves to the left along the trail to the position associated with the move incrementor of five additional moves on Participant C's next turn. It should be appreciated that in this example, rather than simply moving as far as possible with the determined number of position, Participant C recognized that since the community game include multiple rounds, the five additional moves may be more beneficial toward winning the community game than moving to any other position and thus selected to accumulate the five additional moves.

In this illustrated example, since each of the participants have moved along the trail, the second round is complete and the gaming system advances to the third round. As described above, for the third round, before moving any of the participants along the trail for this third round of the community trail game, the gaming system randomly determines a number of position moves for each participant, enables each participant to submit how they want their position moves used and determines an order of movement for the participants.

Figure 4L:
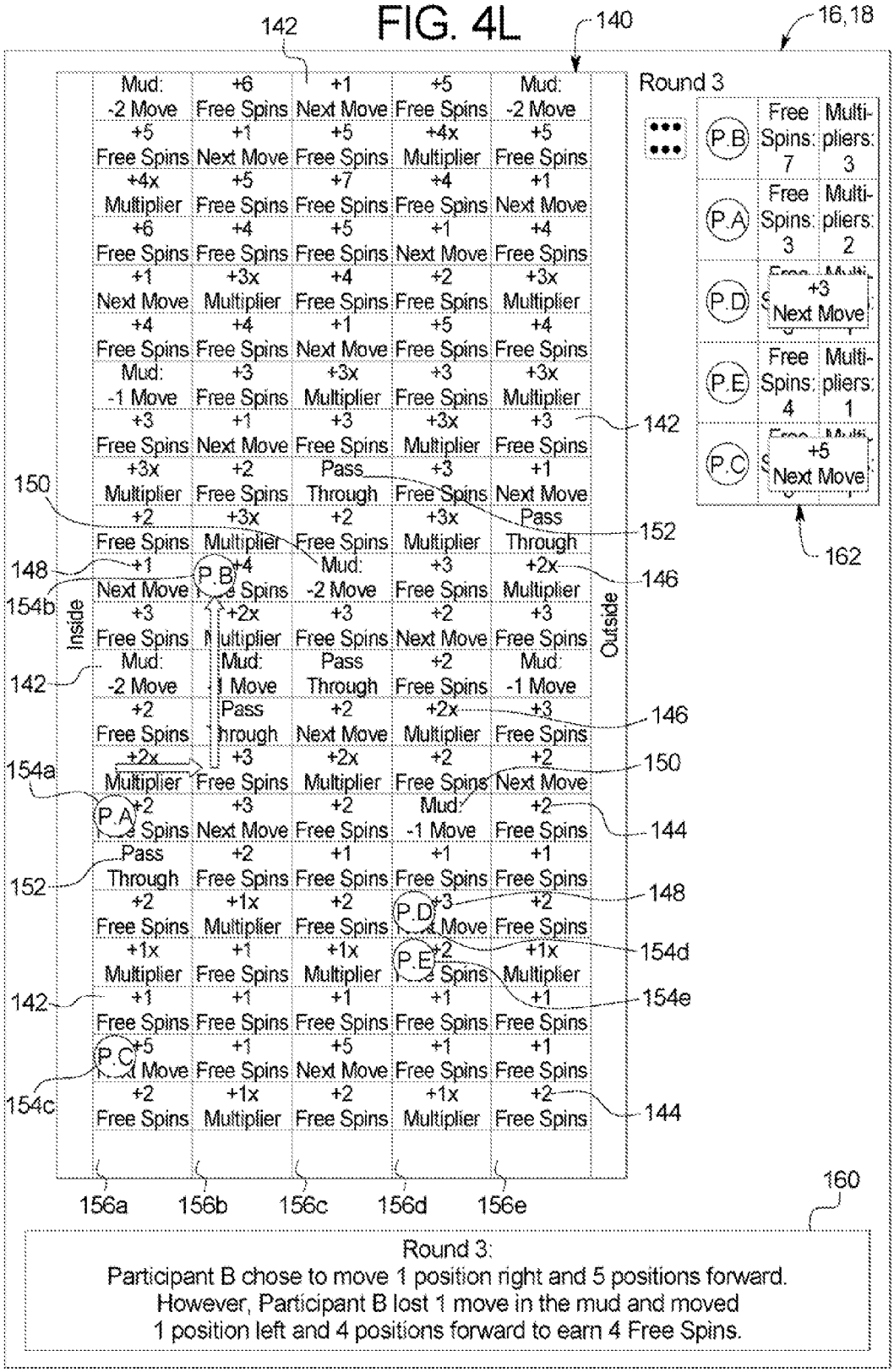

In this example, as seen in FIG. 4L, the gaming system first moves Participant B one move right and five moves forward along the trail to the position associated with four additional free spins and provides or otherwise accumulates four free spins for Participant B. It should be appreciated that since Participant B moved to the position associated with one move decrementor (e.g., Mud −1 Move), Participant B moved five positions total despite the generation of six moves for Participant B.

Figure 4M:
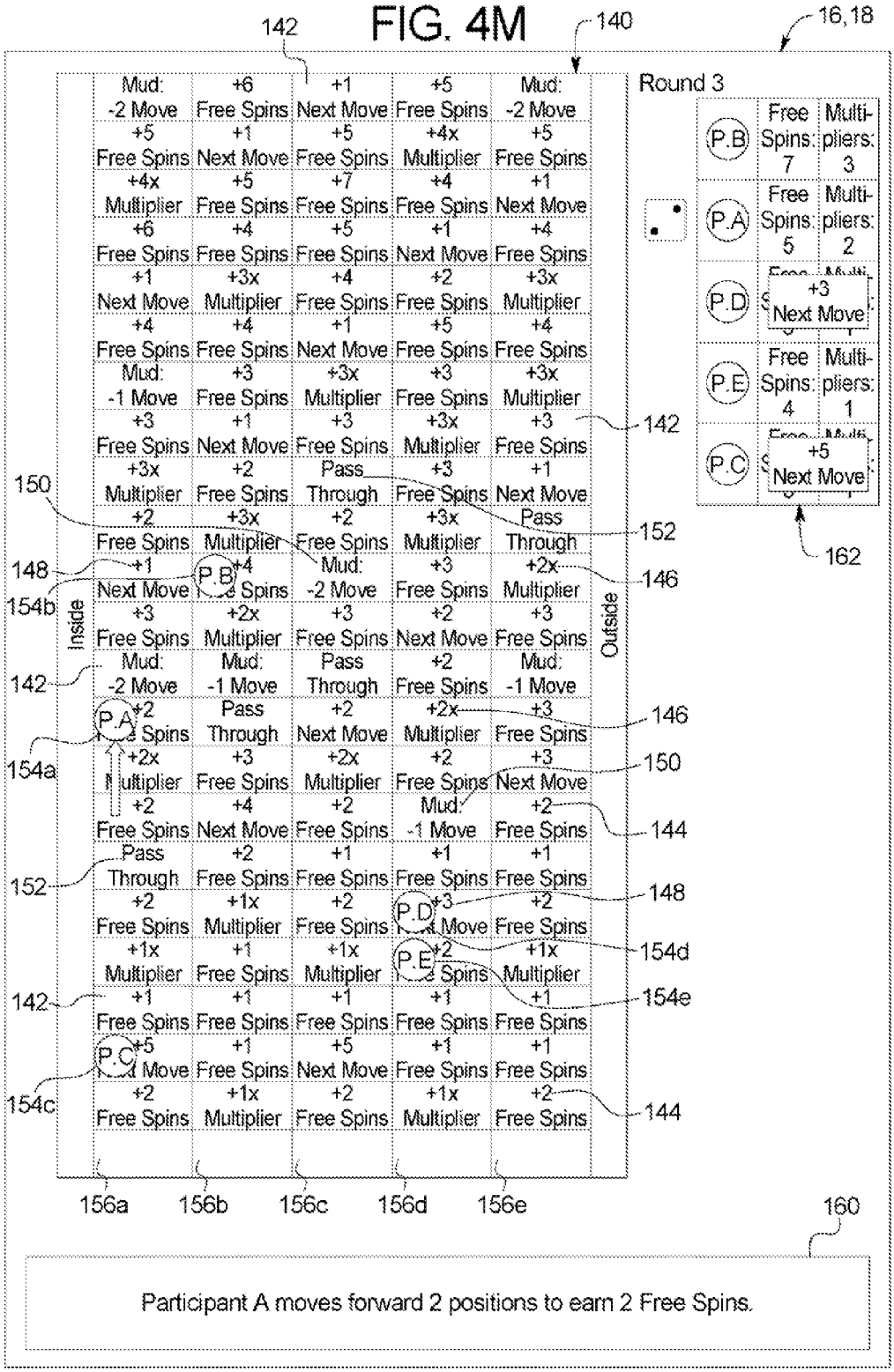
Figure 4N:
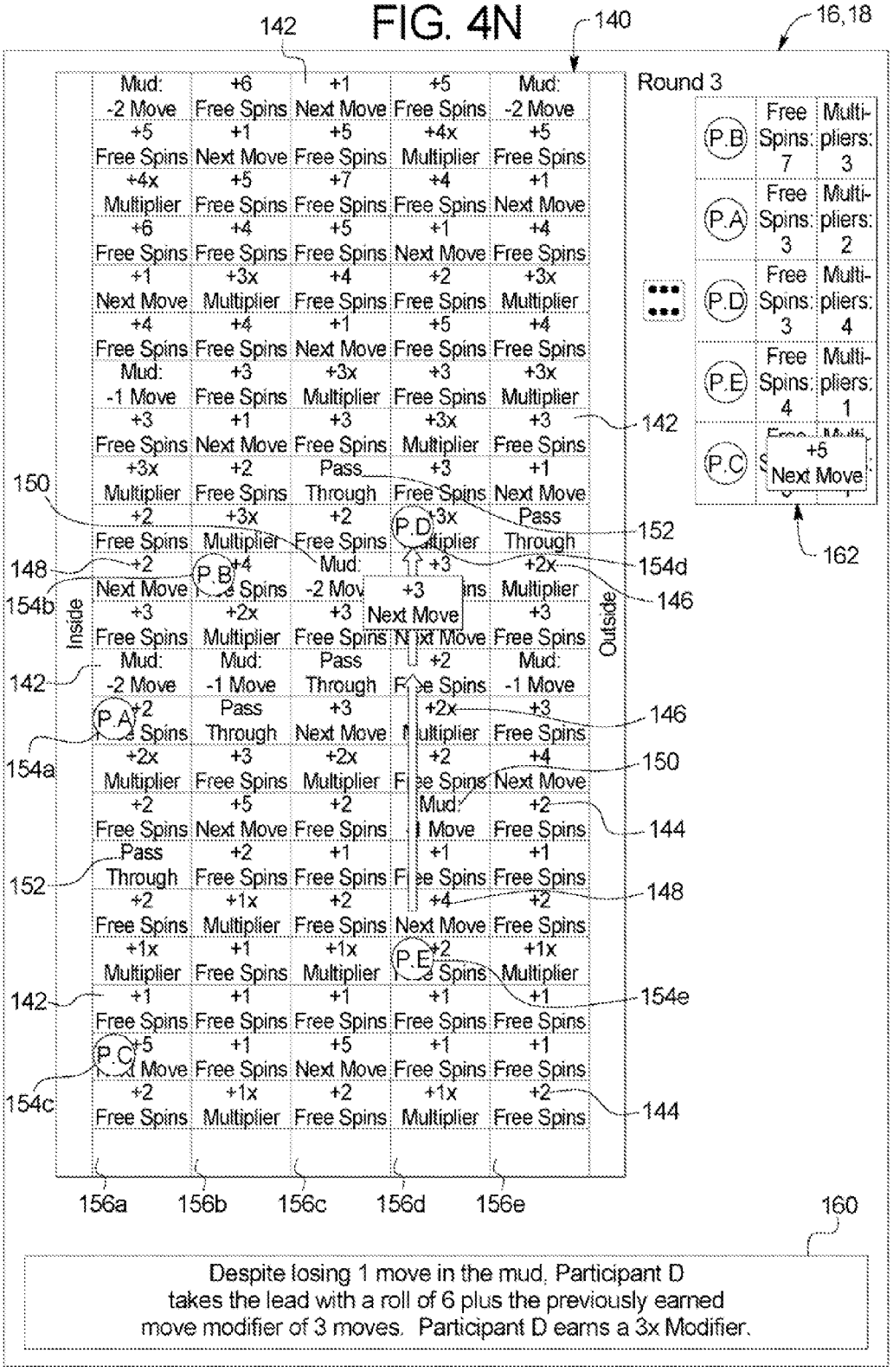
Figure 40:
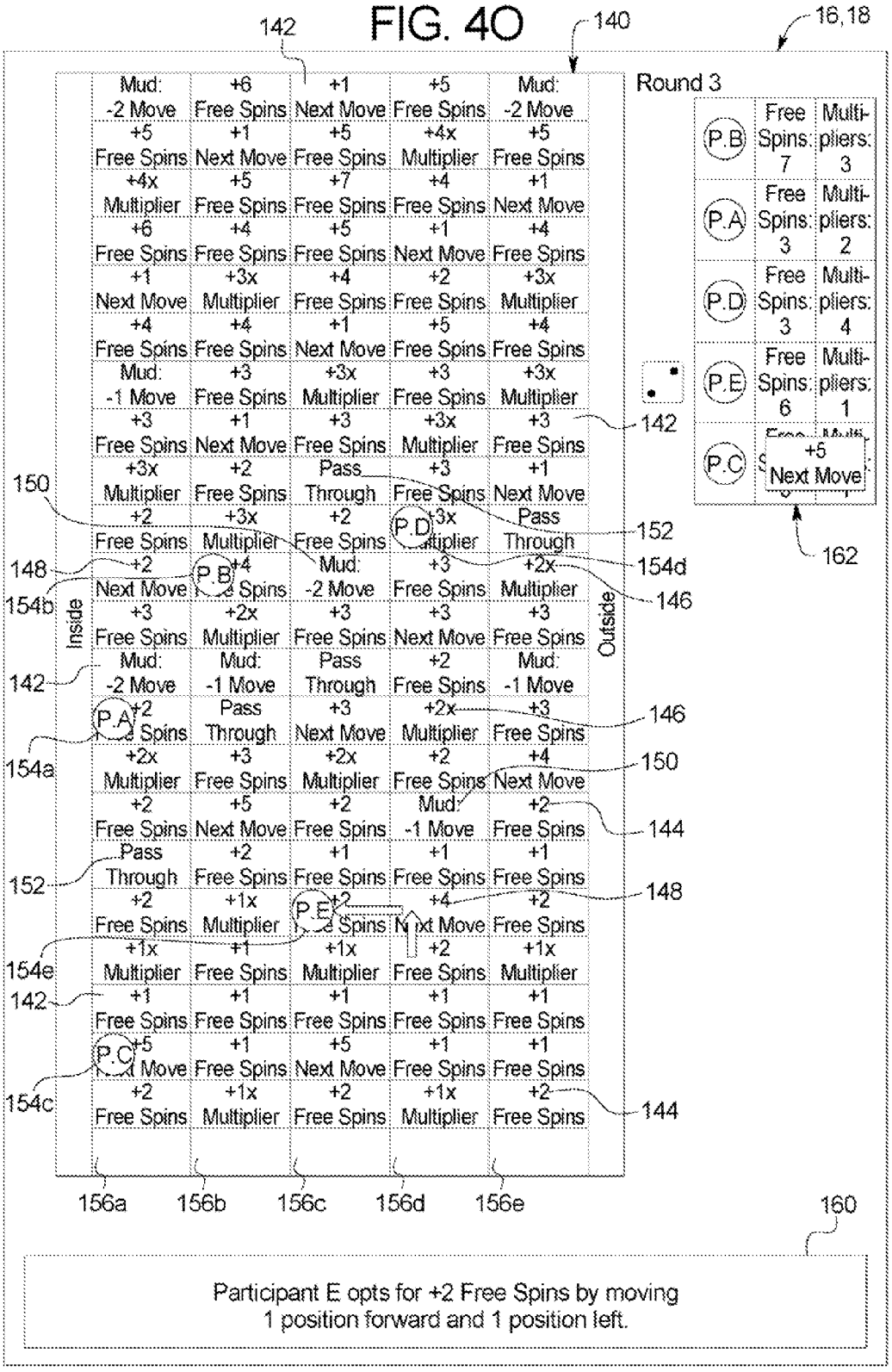

As seen in FIGS. 4M to 4O, each of Participants A, D and E have a free path to their respective designated positions (determined based on each participant's submitted move directions) and the gaming system moves each of Participants A, D and E along the trail accordingly. Specifically, the gaming system: moves Participant A two moves forward along the trail to the position associated with two additional free spins and provides or otherwise accumulates two free spins for Participant A; moves Participant D nine moves forward (i.e., a roll of six moves, three moves from the previously accumulated move incrementor and a loss of one move for the intersected one move decrementor) along the trail to the position associated with a 3× multiplier and provides or otherwise accumulates the 3× multiplier for Participant D; and moves Participant E one move forward and one move left along the trail to the position associated with two additional free spins and provides or otherwise accumulates two free spins for Participant E.

Figure 4P:
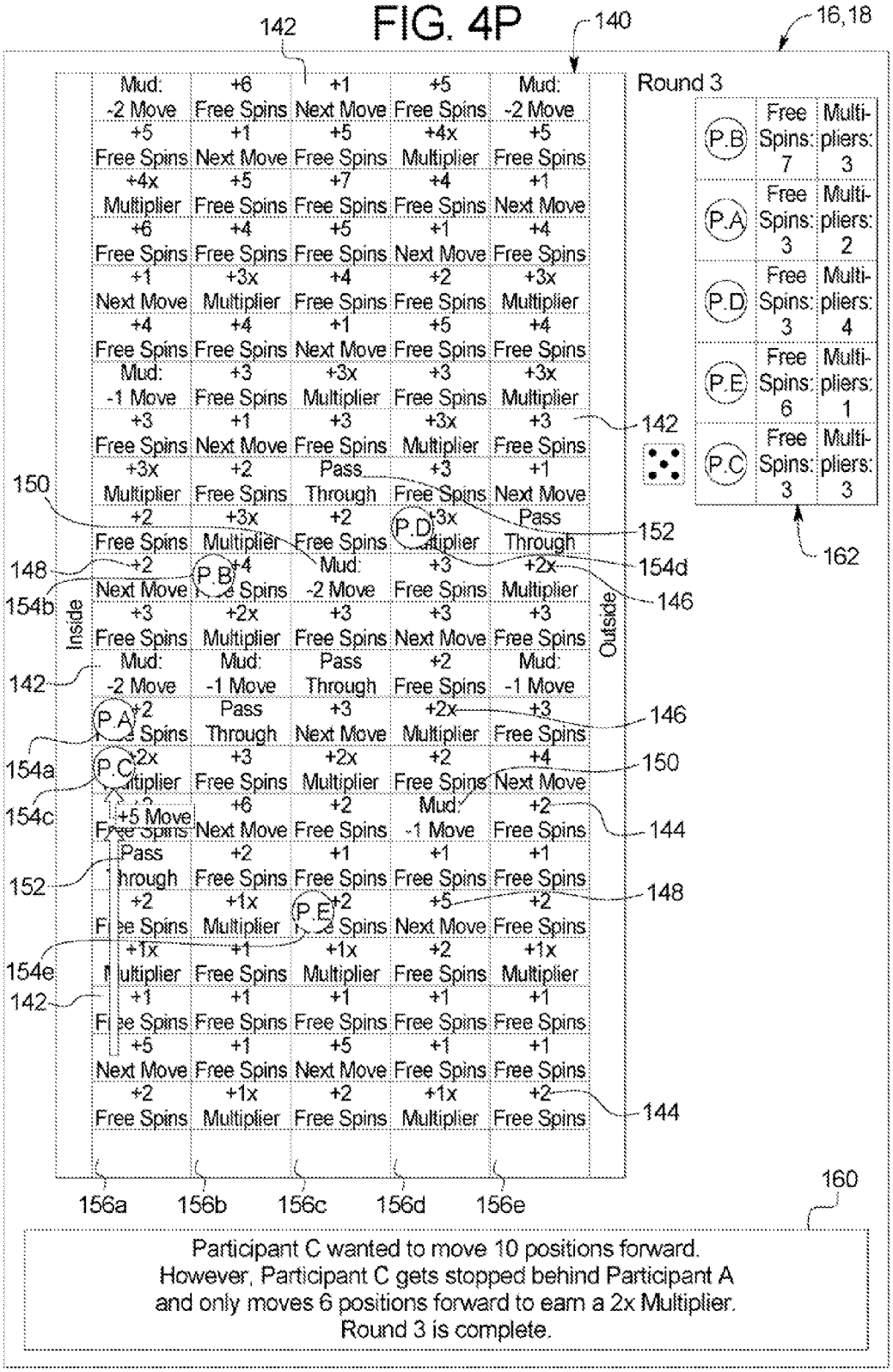
Figure 4Q:
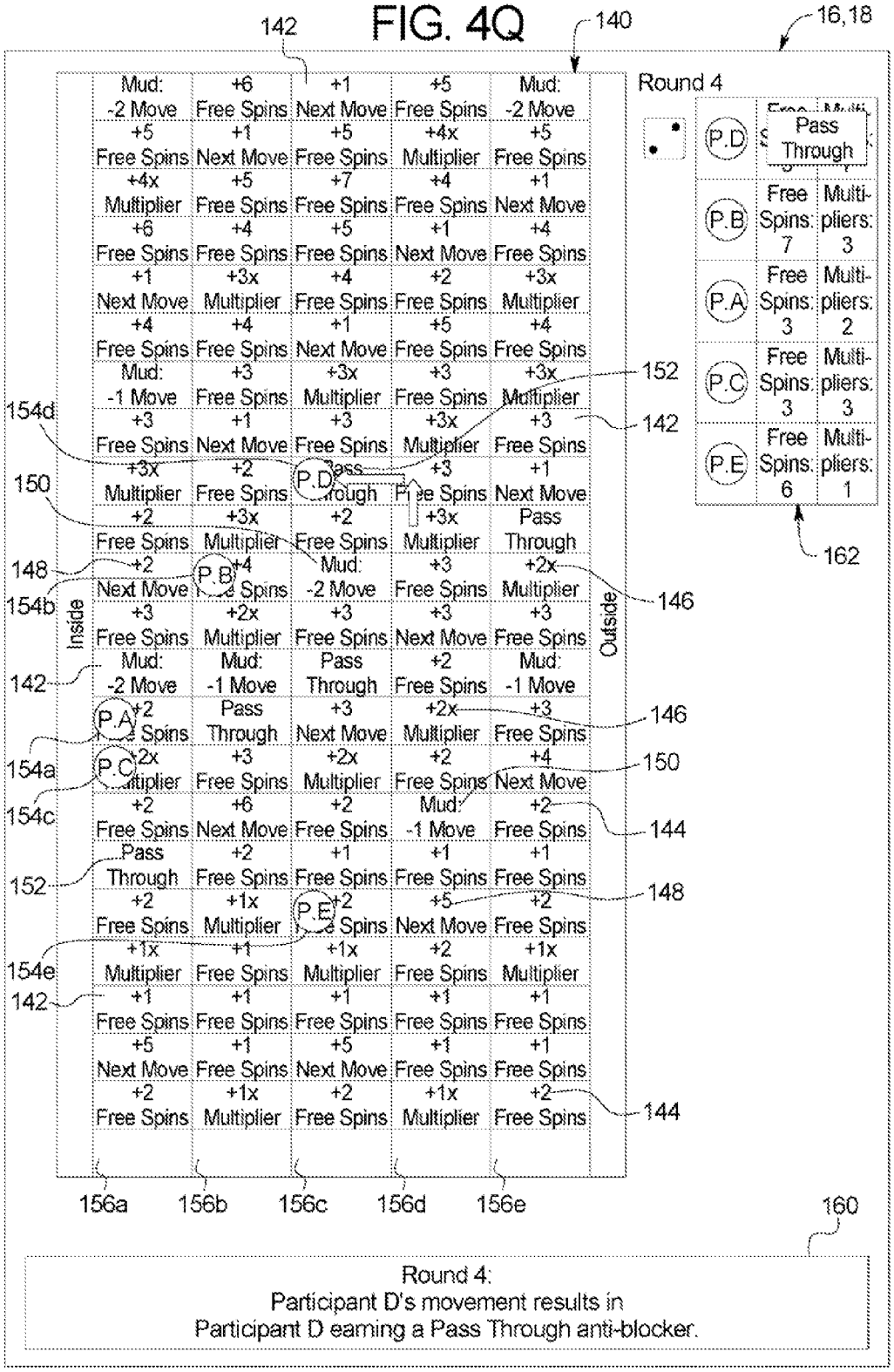
Figure 4R:
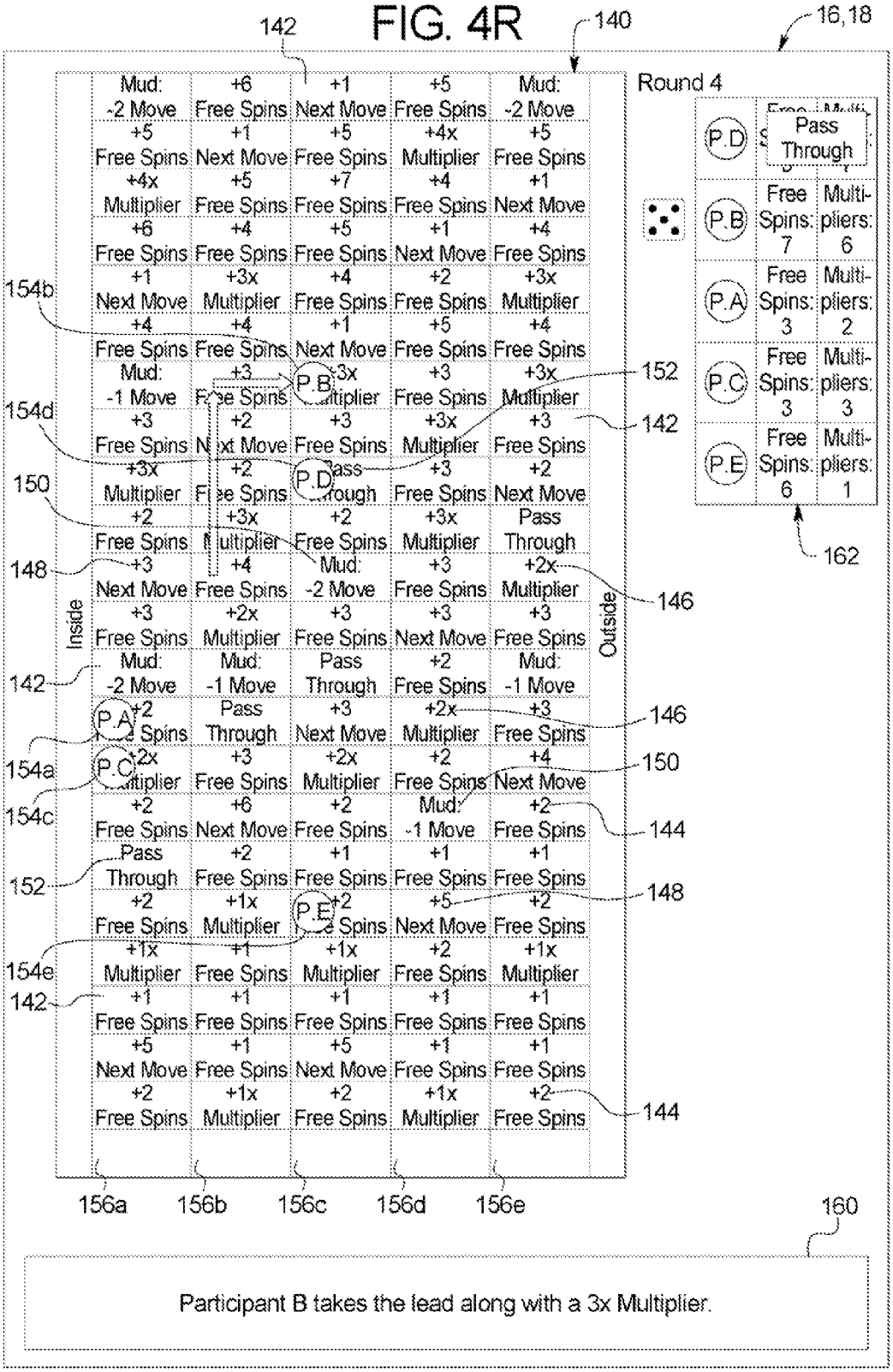
Figure 4S:
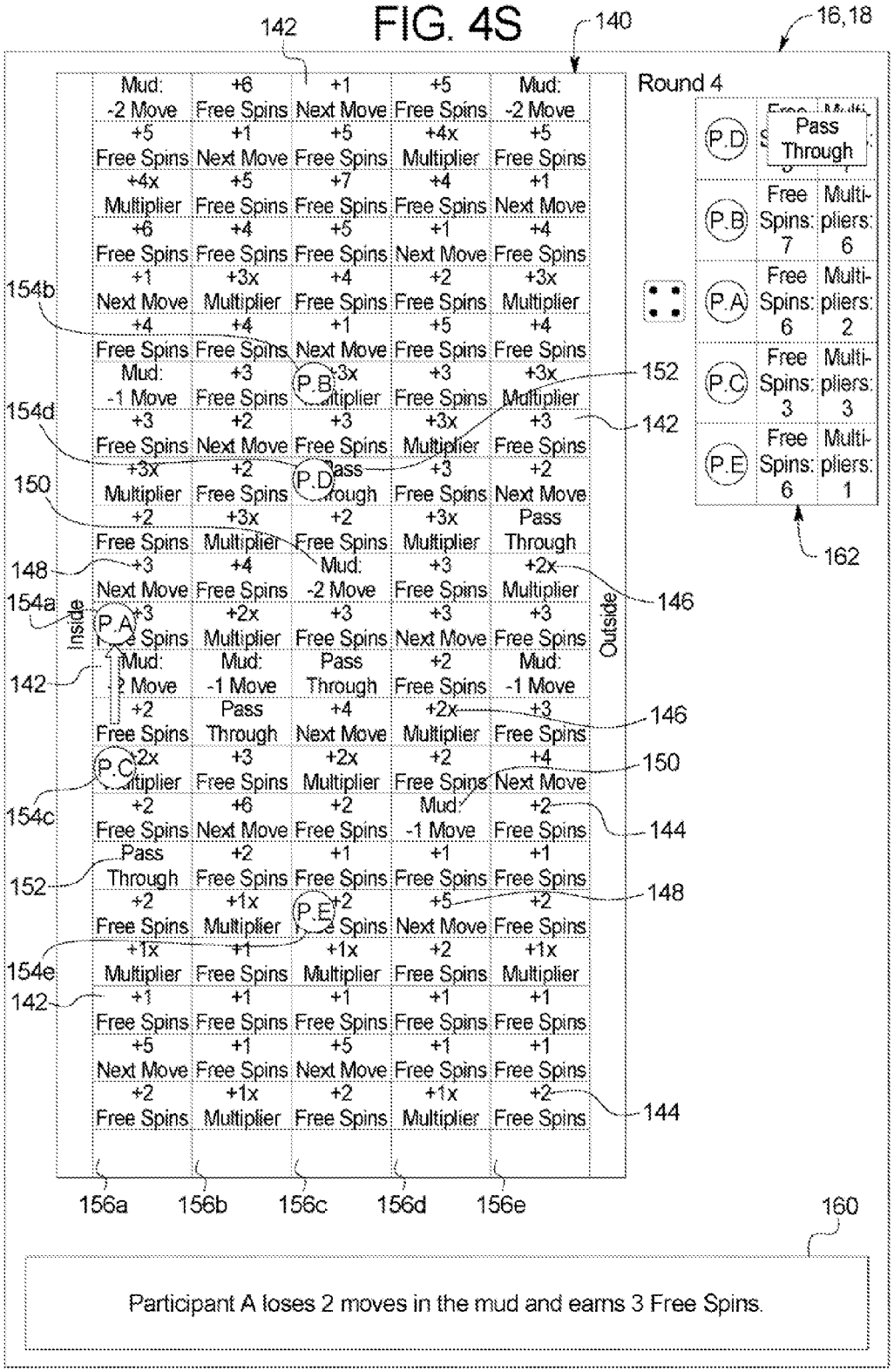
Figure 4T:
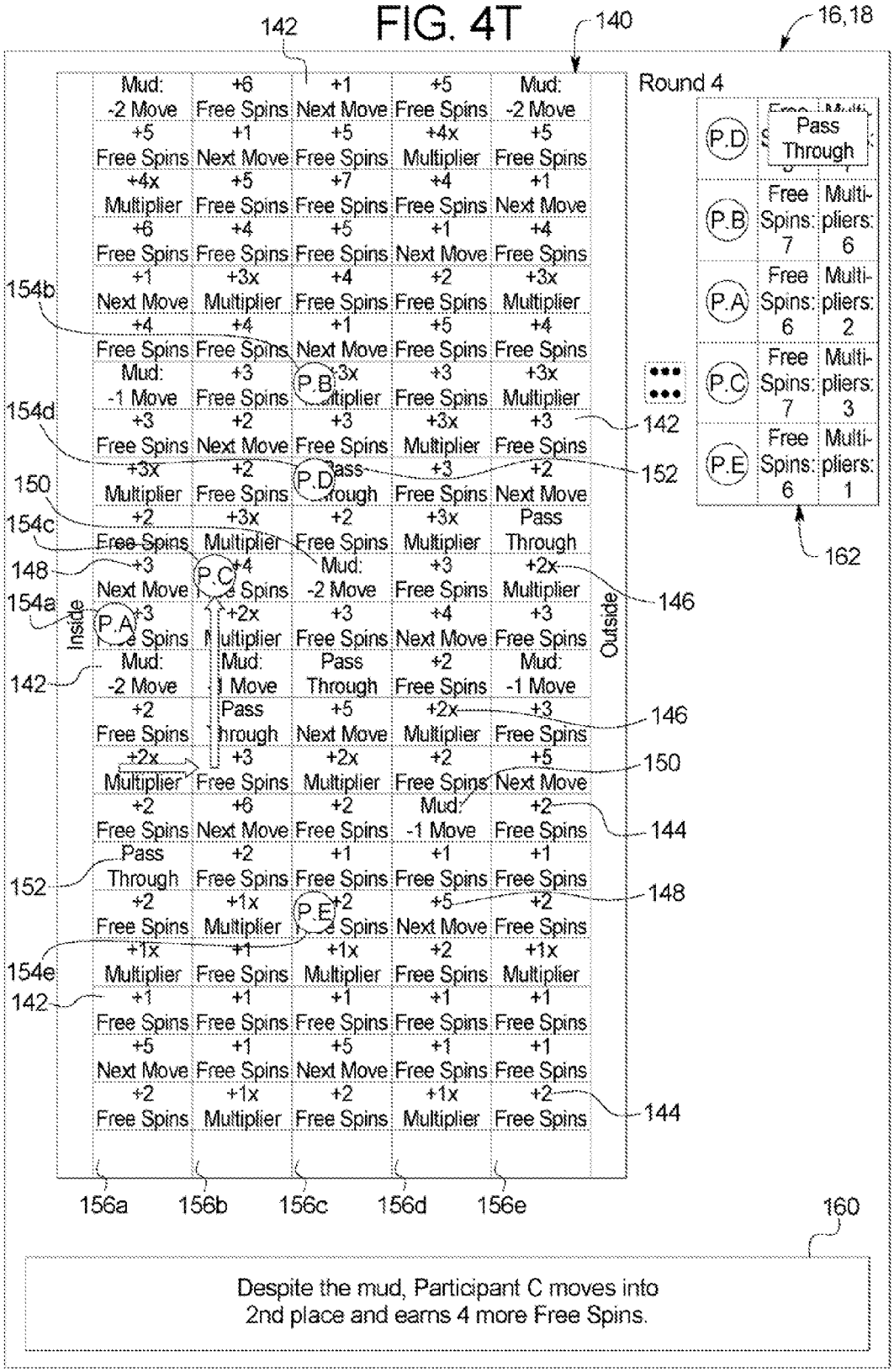

As seen in FIG. 4P, the gaming system determines that, based on the submitted move directions, Participant C has a blocked path. Accordingly, the gaming system moves Participant C to the alternative position associated with a 2× multiplier and provides or otherwise accumulates the 2× multiplier for Participant C.

In this illustrated example, since each of the participants has moved along the trail, the third round is complete and the gaming system advances to the fourth round. As described above, for the fourth round, before moving any of the participants along the trail for this fourth round of the community trail game, the gaming system randomly determines a number of position moves for each participant, enables each participant to submit how they want their position moves used and determines an order of movement for the participants.

As seen in FIGS. 4Q to 4U, each of Participants A to E have a free path to their respective designated positions (determined based on each participant's submitted move directions) and the gaming system moves each of Participants A to E along the trail accordingly. Specifically, the gaming system: moves Participant D along the trail to the position associated with an anti-blocker (i.e., the pass through); moves Participant B along the trail to the position associated with a 3× multiplier and provides or otherwise accumulates the 3× multiplier for Participant B; moves Participant A along the trail (accounting for the passed position associated with a move decrementor) to the position associated with three additional free spins and provides or otherwise accumulates three free spins for Participant A; moves Participant C along the trail (accounting for the passed position associated with a move decrementor) to the position associated with four additional free spins and provides or otherwise accumulates four free spins for Participant C; and moves Participant E along the trail (accounting for the passed position associated with a move decrementor) to the position associated with a 2× multiplier and provides or otherwise accumulates the 2× multiplier for Participant E.

In this example, since each of the participants has moved along the trail, the fourth round is complete and the gaming system advances to the fifth and final round. As described above, for the fifth round, before moving any of the participants along the trail for this fifth round of the community trail game, the gaming system randomly determines a number of position moves for each participant, enables each participant to submit how they want their position moves used and determines an order of movement for the participants.

Figure 4U:
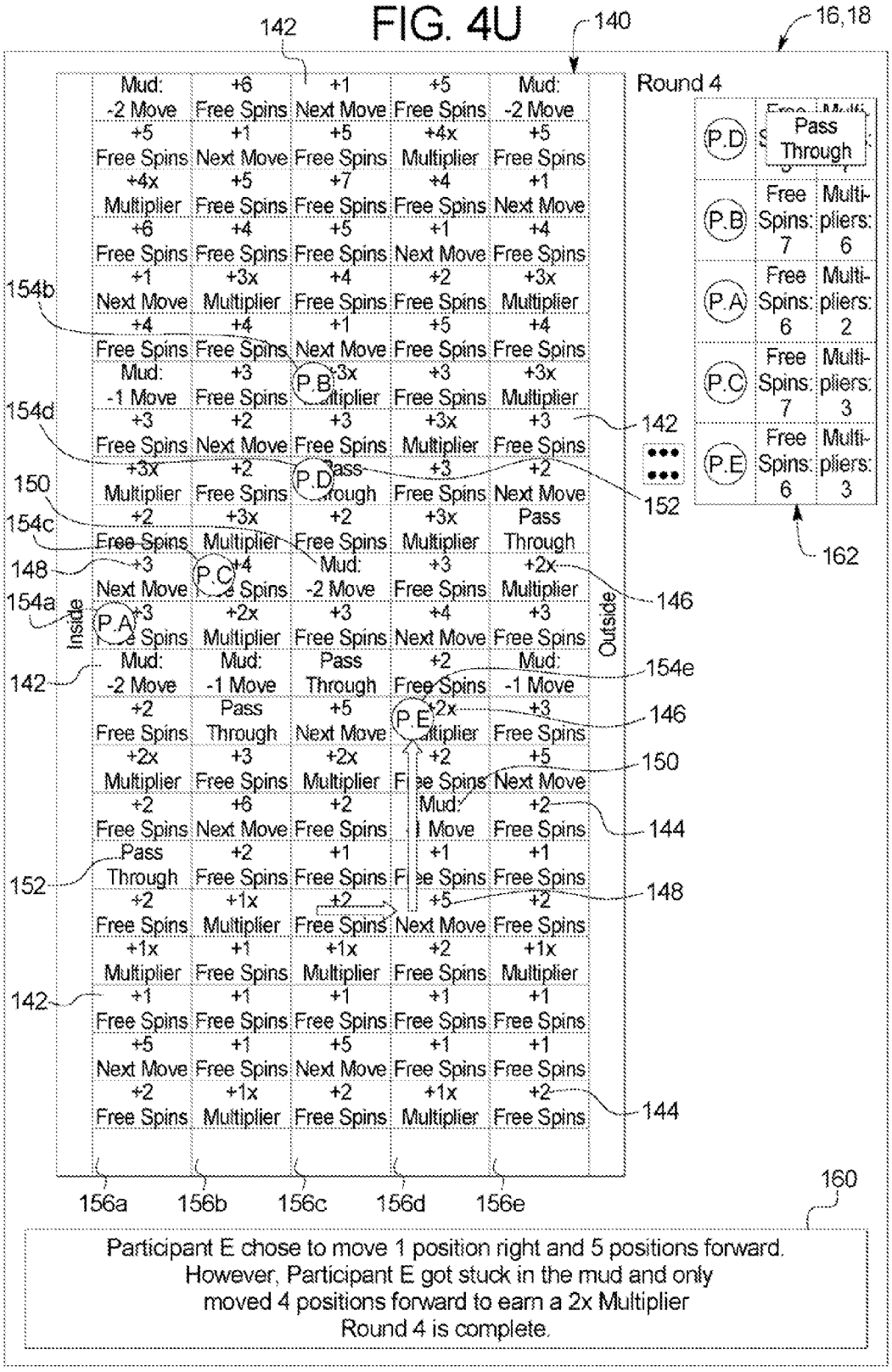
Figure 4V:
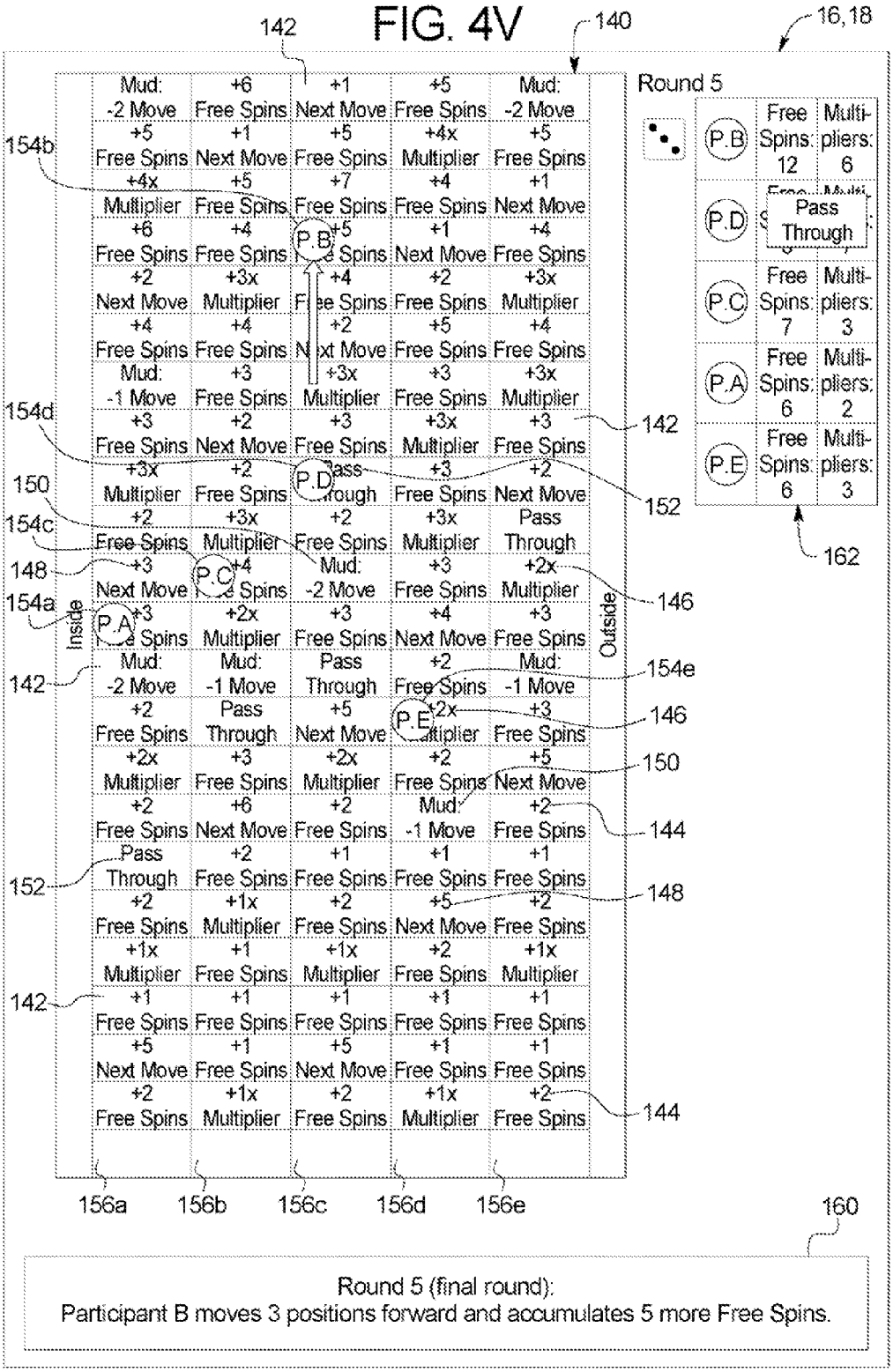

In this example, as seen in FIG. 4U, the gaming system first moves Participant B three moves forward along the trail to the position associated with five additional free spins and provides or otherwise accumulates five free spins for Participant B.

Figure 4W:
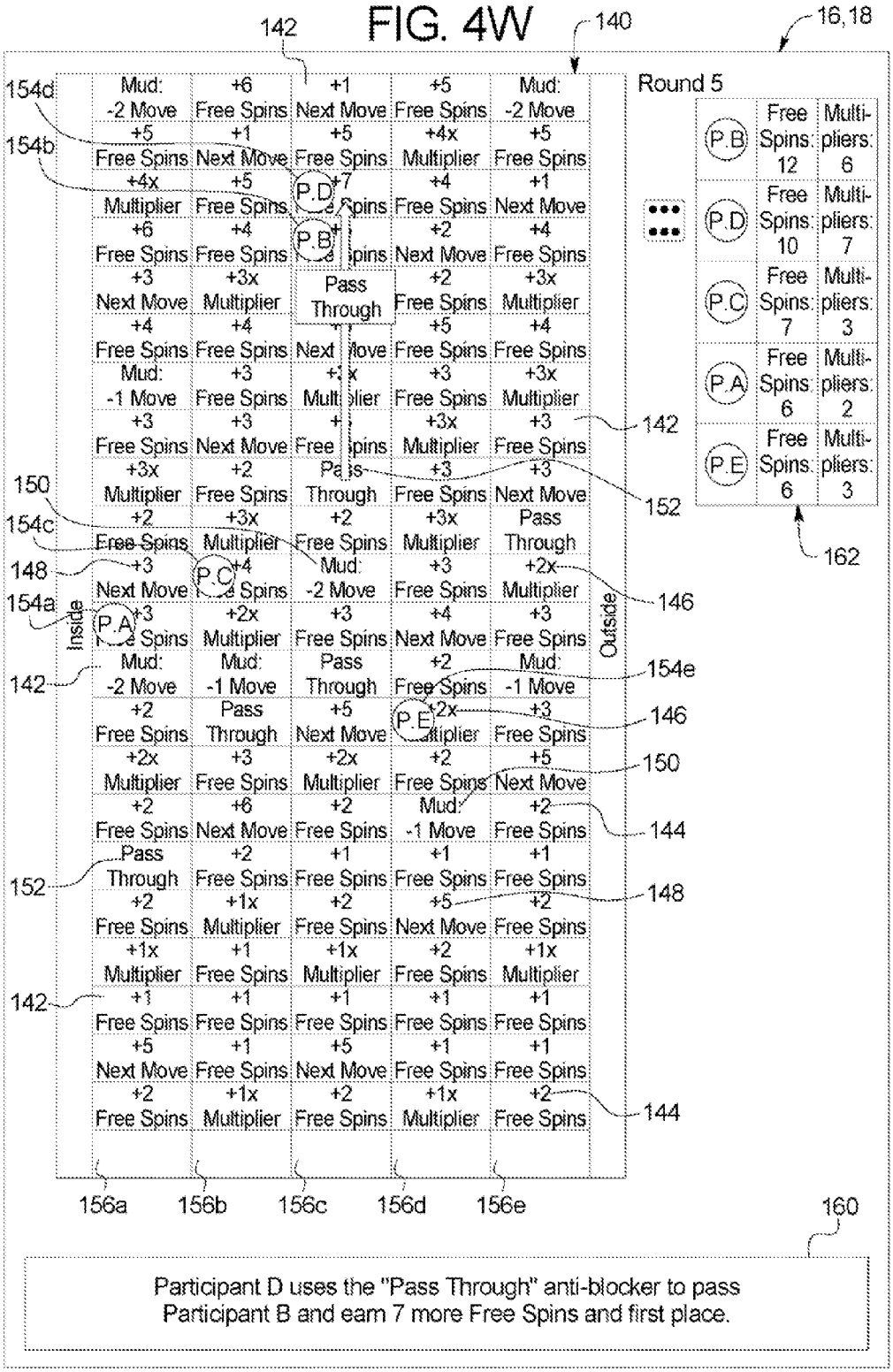

Next, as seen in FIG. 4W, the gaming system determines that, based on the submitted move directions, Participant D has a blocked path by Participant B. However, in this case, the gaming system uses Participant D's previously accumulated anti-blocker to override or pass through the block and continue along the path to Participant D's designated destination position. Accordingly, the gaming system moves Participant D to the position associated with seven free spins and provides or otherwise accumulates seven free spins for Participant D.

Figure 4X:
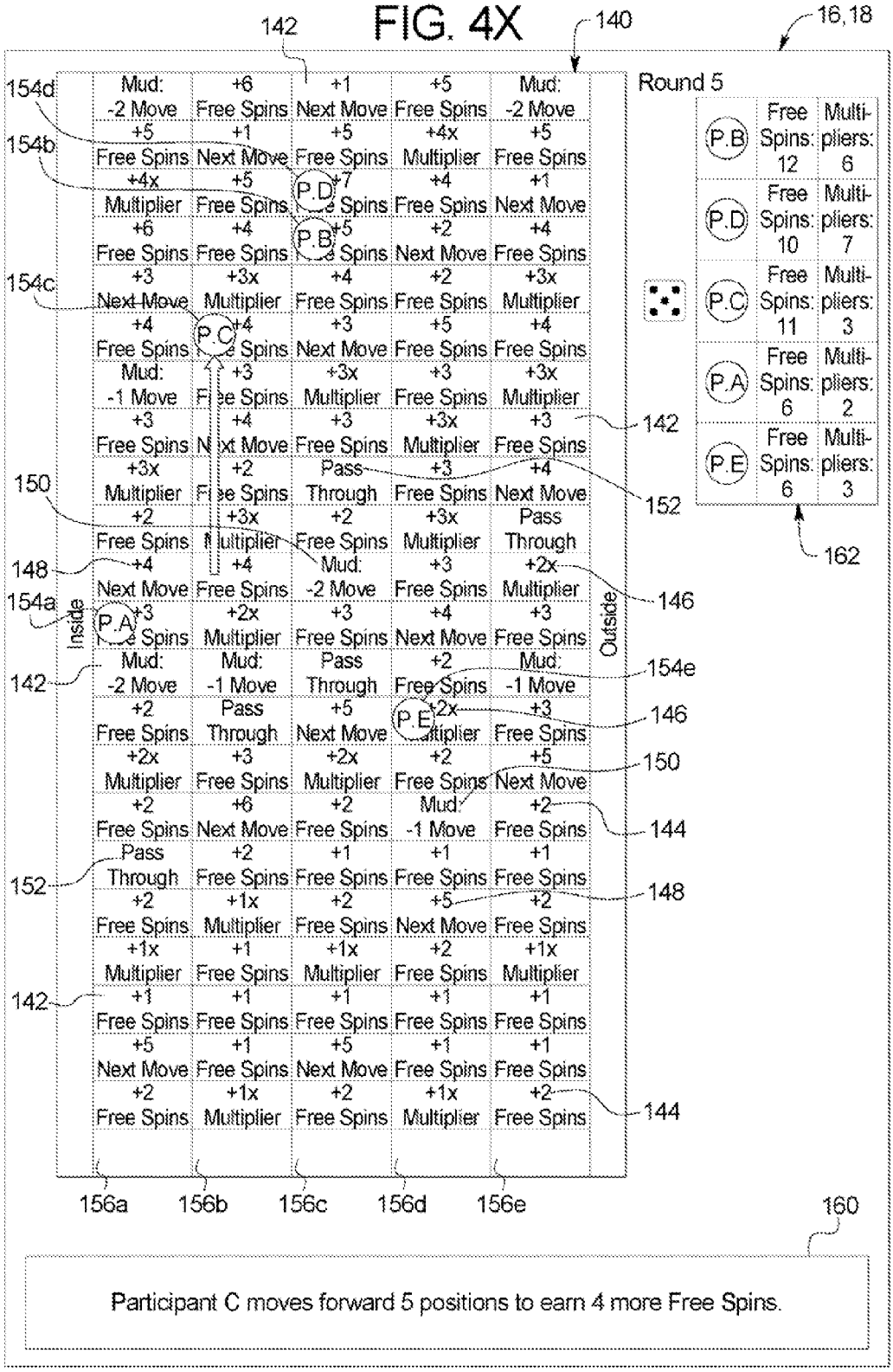
Figure 4Y:
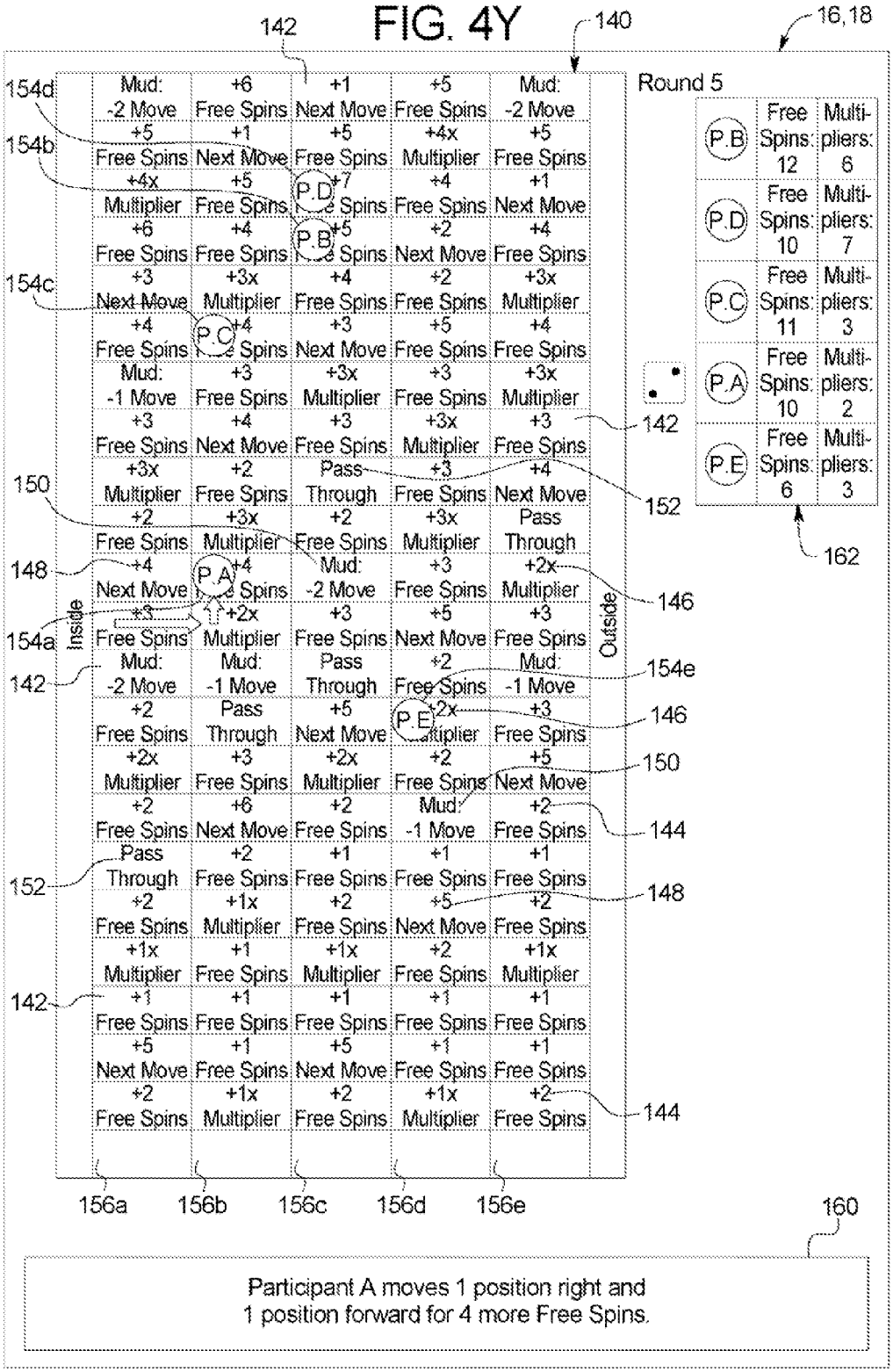
Figure 4Z:
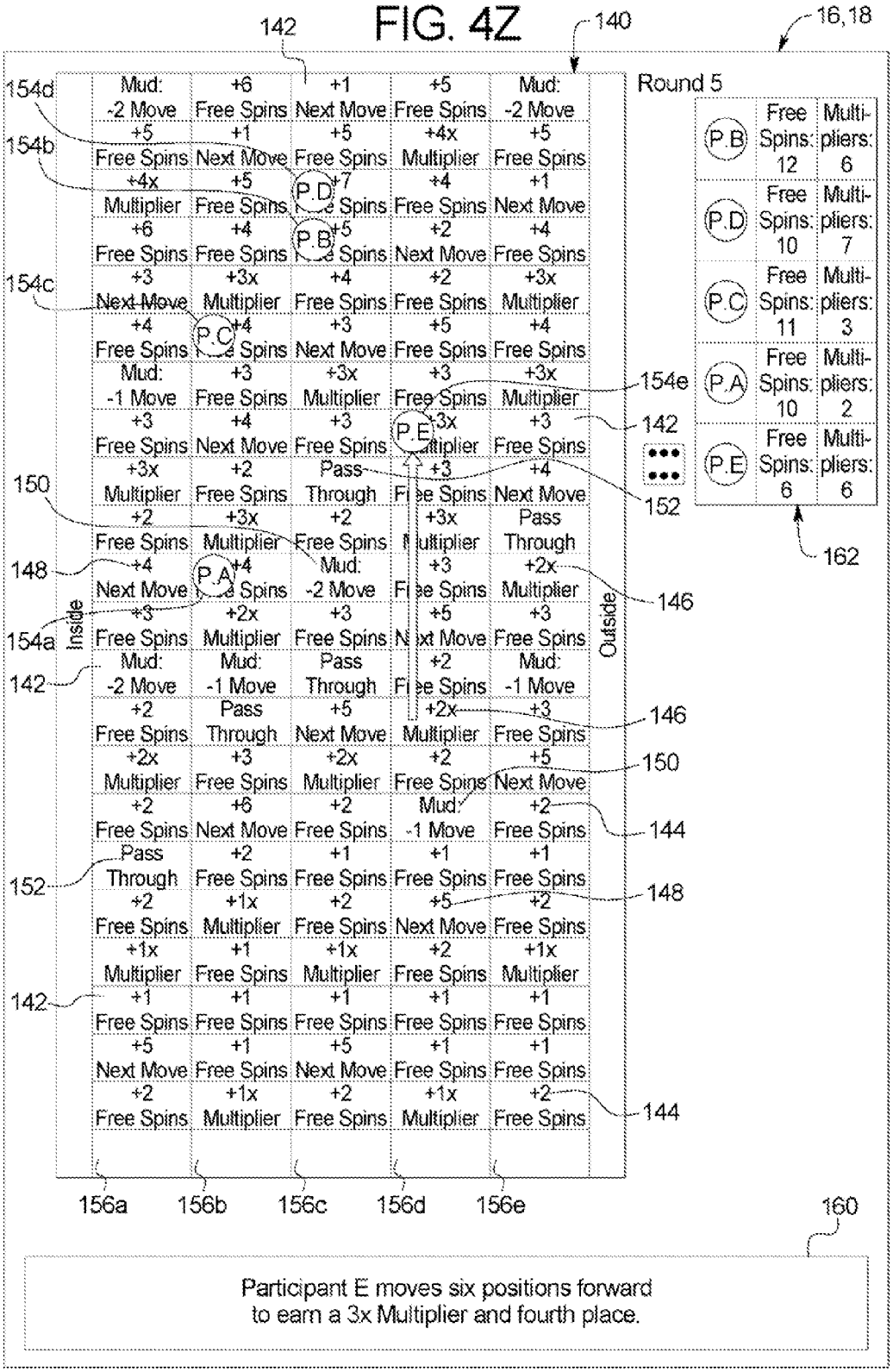
Figure 4A:
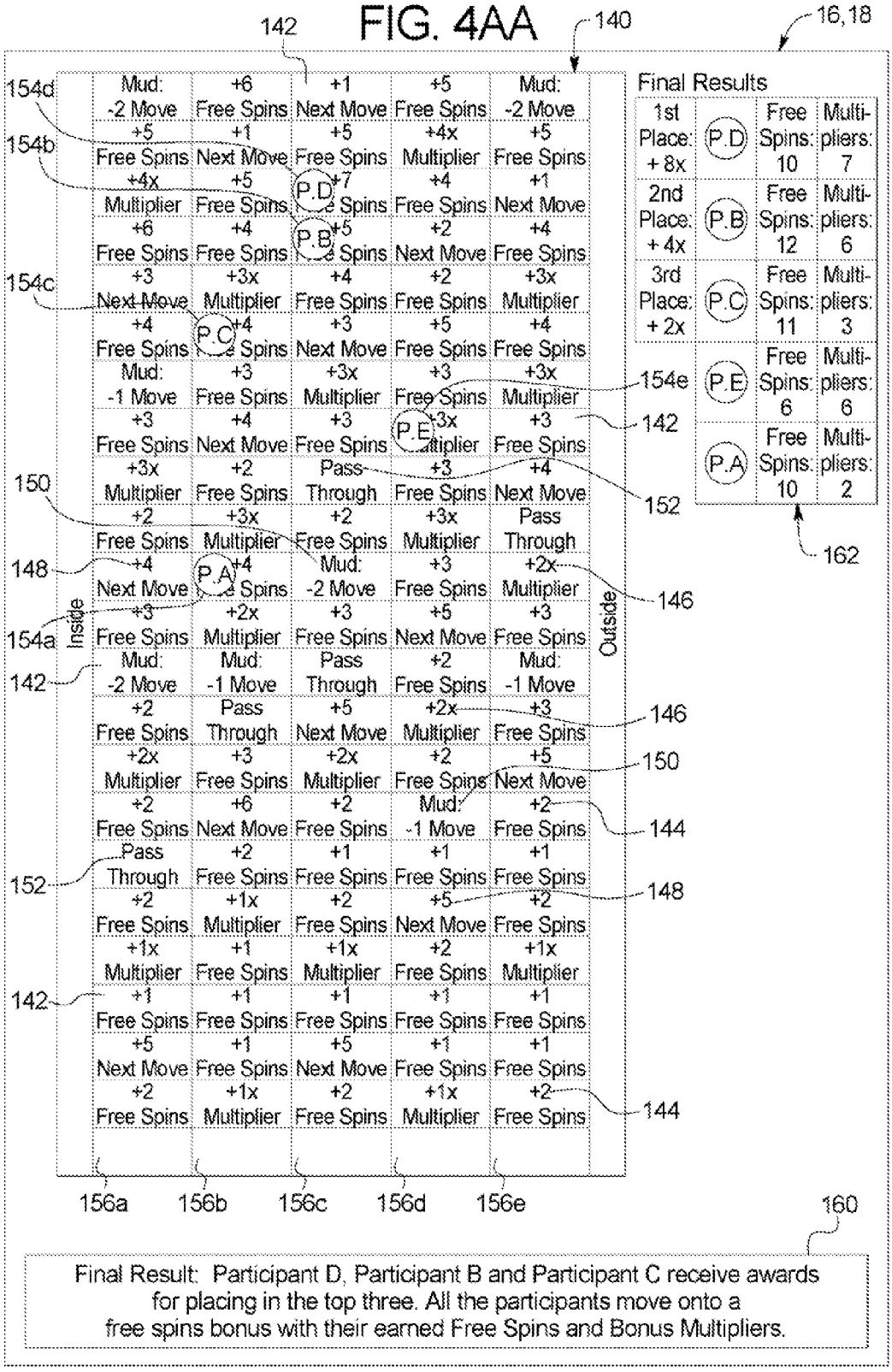

As seen in FIG. 4X to 4Z, the gaming system continues moving participants along the path and accumulating outcomes or awards for the participants. This continues until the gaming system determines that each of the participants has moved along the trail and the final round (and thus the community trial game) is complete. In this illustrated example, as seen in FIG. 4AA, the gaming system provides additional outcomes, such as additional multipliers to the three participants that advanced the furthest in the community trail game. Additionally, in this example (not shown), the gaming system advances to a free spin game in which the participants utilize any free spins and/or multipliers accumulated during the community trial game.

Participants

In one embodiment, each participant is a player playing the community trial game either at a gaming establishment or remotely via a network (i.e., over the internet). In another embodiment, one or more participants are internet gaming bots programmed to play the community trail game. In one such embodiment, the moves these internet gaming bots make during the community trail game are based on one or more player's moves in one or more previous plays of the community trail game. That is, in this embodiment, a player would be playing against players' racers who previously played the community game. In one such embodiment, the gaming system stores the movements of all players who played the community game. When a player triggers the community game, the gaming system randomly picks a designated quantity of players who previously played the community game, and uses the previously recorded movements of those players in the community game. These random picks are based on the position of the player's racers. For example, a given race may require internet gaming bots in positions 1, 2, and 5. In this example, the gaming system picks random previous players who started in positions 1, 2 and 5 to insure that the previously players' movements stay within the bounds of the racetrack. Such embodiments provide that player's will have a full set of participants available to play the community trial game.

In one embodiment wherein a participant in the community game is a player, the gaming system associates a bot with that player for one or more subsequent plays of the community trail game. In this embodiment, the gaming system enables the player to win an additional award depending on how the bot associated with that player performs in the subsequent community trail game. For example, the gaming system provides the player associated with the participant bot an award if the associated participant bot wins the community trail game. That is, this embodiment of the gaming system provides that a player's participant or racer participates in at least two community trail games, once as an active participant (i.e., as described above) and once as an inactive participant (i.e., as a bot). It should be appreciated that a player may win awards as a primary participant (i.e., not a bot) by landing on positions and by winning the race. Moreover, the player may also win an award as a challenge participant (i.e., associated with a bot) by winning the race (i.e., from the perspective of the challenger participants, the positions on the trail are empty or not associated with any outcomes).

In operation of one such embodiment, the gaming system records all of the movements of every player who plays the community game. For example, the gaming system might store the movements of Players A, B, C, and D. In this example, when Player E triggers the community game, the gaming system uses the previously recorded movements of Players A, B, C, and D to control the challenger participants in Player E's game. More specifically, as the game progresses, the gaming system determines the current situation of the trial (i.e., which participants are located where and how many moves may each participant make) to determine what any prior participants did in the prior play of the community game when facing the same (or similar) situation.

In this example, if any of the challenger participants win Player E's game, the gaming system awards the respective player a designated award for the winner of the game. In this example, if Player A's participant wins Player E's race, Player A would win the designated award (such as a progressive award or a quantity of free spins) available for the winner of that race. It should be appreciated that since Player E's race may not happen while Player A is either at the gaming establishment or currently online, the gaming system encourages players to return to the game frequently to see if they won any races while they were offline. In this example, when Player A returns online, the gaming system enables Player A to watch a replay of the race that occurred while they were offline.

In another embodiment, upon a suitable triggering event, the gaming system provides a future play game piece to a player. Each future play game piece represents a player's participation in one or more subsequent community game (i.e., a player specific bot). In this embodiment, upon be provided a future play game piece, the player selects from a list of different strategies to be applied to that game piece for the subsequent community game. That is, in this embodiment, the gaming system enables a player to customize a personal bot for future community games, wherein the customization is based on a selected predefined strategy. In another embodiment, the gaming system enables a player to customize a personal bot for future community games by inputting one or more individual rules pertaining to one or more strategies or decisions for a personal bot to make during a play of a future community game. In different embodiments, examples of such rules include, but are not limited to: always move to the highest number of free spins, always move to the highest multiplier, always move forward as far as possible, and always move to designated movement modifiers.

In another embodiment, when the gaming system is initially started, the gaming system does not have the available data to run any bots based on any players previous plays of the community game (because no players have played the trail game yet). In this embodiment, one or more default bots are used and as players play the community game, the gaming system builds an applicable database of such player's decisions. As the database becomes more extensive, the gaming system relies more on the previous play bots (i.e., the bots that base decisions based on player's previous plays) and less on the default play bots (i.e., the bots that base decisions based on a predefined schedule or otherwise independent of any player's previous plays). Such an embodiment thus provides a transition from employing default bots to employing customized bots based on actual player's decisions in actual plays of the community game.

In another alternative embodiment, prior to the play of the community game, the gaming system enables each player to choose their participant from a list of unique participant icons (such as different colored cars, or cars of different types, or different animals) or from one or more avatars associated with the player. In another embodiment, each of the players share the same participant icon but each participant icon is labeled with the player's unique name or avatar.

In another embodiment, the community game is triggered periodically, such as every ten minutes. In this embodiment, players qualify for the community game during a qualification period and upon the time-based community game triggering event, the qualified players participated in the community game. In certain circumstances, such an embodiment increases the number of actual player participants (rather than bot participants) in the play of the community game.

Path and Trail Positions

In one embodiment, as described above, the trail or path includes a plurality of positions grouped as a plurality of lanes. In one such embodiment, to provide that a participant has at least one avenue to move forward on the path, the trail or path includes at least as many lanes as participants.

In one embodiment, as described above, each position on the path is associated with an outcome. In this embodiment, the outcomes include, but are not limited to: credit amounts, quantities of free activations or spins, modifiers such as multipliers, accumulators (e.g., collect X number of accumulator symbols and win a progressive award), picks of selections, position move incrementors (e.g., gain X number of moves on your next movement or double your next movement), position move decrementors (e.g., lose X number of moves on your next movement), anti-blockers (e.g., jump over or pass through a blocking participant) and participant movers (e.g., an outcome which causes one or more other participants to be relocated one or more positions along the path). In one embodiment, the first participant that lands on a position associated with an outcome is provided that outcome, but other participants that subsequently land on that position are not provided that outcome. Alternately, an outcome remains active and is provided to each participant that lands on a position associated with that outcome. In one such embodiment, an outcome associated with a position is only activated if a given participant stops on that associated position.

In another embodiment, certain of the positions are associated with penalty outcomes, such as, but not limited to: a lose a turn penalty, a lose x multipliers penalty, a lose y free activations or spins penalty, a lose z amount of credits collected so far penalty, a move last on the next turn penalty, a move back n spaces penalty, and/or a move back to start of trail penalty. In one embodiment, the first participant that lands on a position associated with a penalty outcome is appropriately penalized, but other participants that subsequently land on that position are not penalized. In one embodiment, if the first participant lands on a position associated with a penalty outcome but that first participant is able to avoid the corresponding penalty, then that penalty is removed from the path and any subsequent participants are safe from it. Alternately, a penalty outcome remains active if not provided to at least one participant. In another embodiment, a penalty outcome is hidden or otherwise masked until activated. In one such embodiment, a penalty outcome associated with a position is only activated if a given participant stops on that associated position. In another embodiment, the penalty outcome is activated if a participant attempts to cross that position. In this embodiment, if the participant is able to avoid the penalty, the participant can continue to move towards that participant's inputted destination position. Alternately, the participant stops at the position irrespective of the penalty assessment. In another embodiment, if a participant passes through or steps over but does not end on a position associated with a penalty outcome, the act of crossing the position associated with the penalty outcome causes the penalty outcome to become unmasked or displayed. In one variation, this display of the penalty outcome disables the penalty outcome. In another variation, the penalty outcome is still armed but is simply now visible.

In one embodiment including penalty outcomes, the penalty is assessed based only on the result of a secondary outcome. For example, upon landing on a position associated with a penalty outcome, a participant is penalized if they throw a die and get an odd number, or press a button to stop a light display or text display, and the button press does not lead to a designated outcome or the participant guesses incorrectly in a high-low proposition.

In one embodiment, the magnitude of the outcome changes as the trial progresses. For example, positions located further from the starting positions of the trail will, on average, be associated with higher value awards. In another embodiment, the award values associated with various positions along the trail are variable. In one such embodiment, the value of a position increases each time a participant lands on a spot (or passes by a spot). In this embodiment, participants are lagging behind have greater valued positions available to them. For example, Participant A lands on a position that is worth "1 Free Spin." Participant B is lagging behind and lands on the same position on the following turn. This time around, the value of that position might have increased to "2 Free Spin" to help compensate Participant B for being behind in the race. In another such embodiment, the value of various positions decrease in value each time a participant lands on that spot (or passes by that spot). In this embodiment, the first participant who reaches each position is provided the highest value award for that position while subsequent participant landing on that same position will get lesser awards. It should be appreciated that different disclosed trail position features can be simultaneously employed for one or more of the positions along the trail.

In one embodiment, the trail or path is considerably long with the expectation that participants would rarely reach the end of the trail where the position awards are largest. In this embodiment, a participant only has to be furthest along the trail by the end of the last turn to win the community game, not to reach the end of the trail first. In another embodiment, the community game continues until at least one participant reaches the finish line.

In another embodiment, the trail includes various features such as curves, bridges, or obstacles. In one such embodiment including a curved trail, the outside lanes may be longer than the inside lanes, making it desirable for participants to claim the inside lanes. It should be appreciated that when the participant changes lanes (i.e., moves left or right instead of straight ahead), it costs the participant one move and thus changing lanes slows the participant down. It should be further appreciated that as the path may include a plurality of curves in a plurality of different directions, the inside and outside lanes may vary depending on which portion of the path the participant is currently located.

Participant Movements

In different embodiments, the gaming system determines the number of position moves for each participant using any suitable mechanism, such as using one or more rolls of a die or a plurality of dice, one or more spins of a spinner or a reel. In another embodiment, the gaming system determines the number of position moves for each participant by scratching off spots on a scratch card. In one such embodiment, the sum total of all scratch spots (i.e., the sum total of all position moves) may be the same for a plurality of or all of the players, but the distribution of these numbers may be randomly different for each player (e.g., if there were four scratch spots, every player may have scratch spots whose sum total is 20, but a first participant may have scratch spots: 5, 5, 2, 8 and a second participant may have scratch spots 10, 5, 2, 1). In different embodiments, the determination of the number of position moves for one or more participants is predetermined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In certain embodiments, the random move determination is accomplished by a visible random element such as rolling a die or spinning a wheel. In these embodiment, displaying the random move determination provides that all players understand the minimum and maximum moves possible and the likely odds of each movement occurring. This knowledge enables players to better plan their moves. In another embodiment, the random move determination is changed throughout the course of the bonus game. For example, if the random determination is a wheel, the move values on the wheel increase after each round. In another embodiment, the random move determination is accomplished through a limited diminishing set of random movement values (such as a deck of cards). In this embodiment, as a player receives a random movement value from the set, that random movement value is removed from the set and not possible to receive a second time during the same bonus. In another embodiment, a player obtains an outcome associated with a position that alters that player's random move determination for the rest of the game, such as a player obtaining an outcome of "+1 All Future Movements."

In different embodiments, the determination of which participant takes which starting position is randomly determined. In another embodiment the determination of which participant takes which starting position is determined based on each player's bet size. In different embodiments, the determination of which participants being in which starting positions is predetermined, determined based on a player's status (such as determined through a player tracking system), determined based on a generated symbol or symbol combination, determined based on a random determination by the central controller, determined based on a random determination at the gaming device, determined based on one or more side wagers placed, determined based on time (such as the time of day) or determined based on any other suitable method or criteria.

In one embodiment, as described above, the gaming system determines an order of movement based on each participant's current position relative to one or more other positions of the trail. In different embodiments, the determined order of movement is based on different criteria, such as the size of the number of moves in previous round, the number of moves in the current round, the size of any previous award, the size of any total awards, the order which the bonus started, the size of the bonus triggering event, the player status or any other suitable rank determining criterion.

In another embodiment, the community path game disclosed herein is a secondary game and one or more events which occur during the play of a base or primary game for certain players affect the play of the community path game. In one such embodiment, different players may enter the community trail game with different amounts of position moves previously earned during one or more plays of the base game. In another such embodiment, different players may enter the community trail game with different starting positions previously earned during one or more plays of the base game. It should be appreciated that these embodiment potentially provide such players an advantage in winning the community trail game.

In one embodiment, the gaming system displays to each of the players, the position moves that each of the player can make. This embodiment includes an element of strategy or skill as each player surveys the current positions of the other participants of the community trail game and assesses, based on different probabilities of obtaining different numbers of position moves, the likelihood of other participants attempting to move to the same position as that participant. This embodiment further provides participants the opportunity to collaborate their play of the community trail game.

In one embodiment, as described above, a participant inputs a move direction for each move. In another embodiment, the participant inputs a destination position which they want to move to. In one embodiment, if multiple paths each lead to the same destination position, the gaming system automatically follows any available path (as long as movement is unblocked in the starting column or the destination column). In one such embodiment, the gaming system always follows the same path, first moving vertically and then horizontally. In another such embodiment, the gaming system always follows the same path, first moving horizontally and then vertically. On the other hand, in different embodiments, if multiple paths to the destination position are each blocked, the gaming system selects the alternative position: (i) with the greater value, (ii) which uses the greatest number of moves, or (iii) which provides the greatest precedence for the next move. In different embodiment, the gaming system determines an alternative path of the same length to the desired destination that is not blocked by other players. In these embodiments, if no such path is possible, the gaming system moves the player as close to the destination position as possible. In another embodiment, the gaming system enables a participant to first select a destination position along the trail and then select a path to the selected destination position.

In another embodiment, the gaming system displayed to each player a set of possible destination positions based on their random move value. The player chooses their desired destination and the gaming system determines the optimal path to reach that destination. In this embodiment, while there might be several paths of the same length that reach the desired destination position, the gaming system determines the optimal path that avoids any obstacles.

In one embodiment, as described above, each player moves as many spaces as determined randomly. In this embodiment, the player is not enabled to choose a destination position that does not use all of their movement allowance. For example, if the player receives a random movement of 4 position moves, the player would not be enables to choose a destination position only 2 spaces away. In another embodiment, the gaming system enables the player to choose destination positions that do not use all of the determined number of position moves for that round.

In one embodiment, prior to any participant's moving, each player is provided a designated amount of time to input how they want their associated participant to move. For example, the gaming system gives each player a set number of seconds, such as ten seconds, to make their choice of where to move their participant. If a player does not make a choice in time, their participant is moved straight forward by default. In another embodiment, if a player does not input a choice, then a default strategy is employed to move that player's participant along the trail. In one alternative embodiment, the gaming system assigns each player with an initial default destination which each player has the opportunity, within an allotted period of time, to change or otherwise modify. In one alternative embodiment, the gaming system designates one of the possible destination positions as the default designation for each player which will become the selected destination if the corresponding player takes no action. In different embodiments, the gaming system enables a player to select a strategy for the gaming system to implement for each move the player makes or individual moves the player makes. In one such embodiment in which the gaming system executes a player selected strategy for one or more position moves, the gaming system enables the player to override the gaming system implemented strategy if the player disagrees with any particular move along the trail.

Blocking

In one embodiment, if a participant is blocked by another participant, as described above, the gaming system stops the participant's movement at the last open or unoccupied position. In different embodiments, the position a blocked participant is moved to is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In another embodiment, if a participant is blocked by another participant, the gaming system moves the blocking participant to another position. In one such embodiment, the blocking participant that is moved is provided the outcome associated with the moved-to position. In another embodiment, the blocking participant that is moved is provided the larger of the outcome associated with the original position or the outcome associated with the moved-to position. In another such embodiment, the blocking participant that is moved is provided the outcome associated with the moved-to position but forfeits the outcome associated with the original position. In another embodiment, the blocking participant that is moved is provided no additional outcome associated with the moved-to position. In these embodiments, the participant that was blocked (and caused the blocking participant to move) ends up at the position previously blocked.

Community Game Conclusion

In one embodiment, as described above, the participant that travels the furthest along the community path is provided a designated award at the termination of the community game. In another embodiment, more than one participant is provided a designated award for the play of the community game. In this embodiment, the awards are based, at least in part, on each participant's relative ending order or ending position. In different embodiments, the designated award include, but are not limited to: a progressive award (that increases during the community game), a quantity of free activations or spins, one or more modifiers, such as multipliers, or a quantity of credits or other monetary value.

In one embodiment, as described above, the community bonus game includes a plurality of rounds (with each round including a movement of each participant) and the terminating event occurs when the final round is complete. In another embodiment, the terminating event is based on when one of the participants has crossed a finish line on the track. In another embodiment, in a game in which participants can be eliminated from the bonus round, the terminating event occurs when there is only one participant left on the track. In another embodiment, each player continues to play additional rounds as long as that player not yet satisfied one or more stopping requirements. For example, if on a given round a first player passed an event-ending position, such as the finish line in a race game, and a second player has not yet attained such a position, a subsequent round of play occurs for the second player but not for first player for whom the community bonus game has ended.

In one embodiment, the community game is used to determine the free spin parameters for one or more qualifying participants when the community game is complete. In another embodiment, the community game is used to determine the free spin parameters for each of the participants when the community game is complete. It should be appreciated that this free spin bonus is not shared and all awards in this free spin bonus are based on the player's bonus triggering bet and currency. Accordingly, the community trail game disclosed herein enables players of different bet sizes and currencies to race together in the same community game, while providing individual awards to such players based on their specific wagering parameters.

In another embodiment, the secondary game is a picking game in which one or more outcomes accumulated during the community trail game determine the quantity of picks and the modifier, such as a multiplier to apply to one or more of the picks.

In another embodiment, the award for winning the community game is determined based on a secondary outcome, such as the spinning of a wheel. This embodiment provides a variable value award for winning the community game. In different embodiments, the award for winning the community game is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In another embodiment, the award for winning the community game is provided to a player if that player also satisfies a secondary condition, such as obtaining one or more designated outcomes during the community game. In another embodiment, the community game represents an entire bonus with the participating players winning credits instead of free spin parameters.

In another embodiment, the award for winning the community game (or obtaining a certain result in the community game) is participation in a tournament. In this embodiment, if a player achieves a certain result, such as finishing in the top two of the community game or attaining a certain outcome, the player is eligible to participate in a future tournament.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) display a matrix including a plurality of different starting positions and a plurality of outcome positions, wherein prior to any movement of any player symbols and prior to any movement of any participant symbols:

(i) each of said outcome positions is associated with one of a plurality of different outcomes, and (ii) the outcomes associated with the outcome positions are selected from the group consisting of: an award, a modifier of a value, a quantity of free spins, a quantity of free activations, an additional quantity of position moves, a quantity of picks, and a reduced quantity of position moves;

(b) display:

(i) a player symbol at one of the plurality of different starting positions, and (ii) at least one participant symbol at at least one of the plurality of different starting positions;

(c) randomly generate a quantity of position moves associated with the player symbol;

(d) for each of the quantity of position moves associated with the player symbol, enable a player to input a direction of movement;

(e) for each of the participant symbols:

(i) determine a quantity of position moves, and (ii) for each of the quantity of position moves associated with the participant symbol, determine a direction of movement;

(f) determine a movement order for each of the player symbol and the at least one participant symbol;

(g) prior to moving each of: (i) the player symbol in association with the quantity of position moves associated with the player symbol, and (ii) each of the at least one participant symbol in association with the quantity of position moves associated with said participant symbol, if the inputted direction of movement for the quantity of positions moves associated with the player symbol corresponds to one of the outcome positions and the determined direction of movement for the quantity of position moves associated with one of the participant symbols corresponds to said same outcome position:

(A) determine which one of the player symbol and the participant symbol to move to said outcome position, and (B) determine which one of the other one of the player symbol and the participant symbol to move to another one of said outcome positions, wherein which of said player symbol and said participant symbol is determined to move to which of said outcome positions is based on the determined movement order;

(h) display the player symbol and the at least one participant symbol each moving to a separate one of the outcome positions, wherein:

(i) the outcome position the player symbol is moved to is based, at least in part, on the player inputted direction of movement, and (ii) for each participant symbol, the outcome position said participant symbol is moved to is based, at least in part, on the determined direction of movement for said participant symbol; and (i) provide the player the outcome associated with the moved to outcome position of the player symbol.

2. The gaming system of claim 1, wherein at least one of the participant symbols is associated with another player.

3. The gaming system of claim 1, wherein when executed by the at least one processor, the plurality of instructions cause the at least one processor to randomly determine the quantity of position moves for at least one of the participant symbols.

4. The gaming system of claim 1, wherein when executed by the at least one processor, the plurality of instructions cause the at least one processor to determine the movement order based on each symbol's relative position to at least one of the outcome positions.

5. The gaming system of claim 1, wherein when executed by the at least one processor, the plurality of instructions cause the at least one processor to operate with the at least one display device to display a plurality of participant symbols.

6. The gaming system of claim 5, wherein when executed by the at least one processor if the inputted direction of movement for the quantity of position moves associated with a first one of the participant symbols corresponds to one of the outcome positions and the determined direction of movement for the quantity of position moves associated with a second one of the participant symbols corresponds to said same outcome position, the plurality of instructions cause the at least one processor to operate with the at least one display device to:

(i) display one of the first participant symbol and the second participant symbol at said outcome position, and (ii) display the other one of the first participant symbol and the second participant symbol at another one of said outcome positions, wherein which of said first and second participant symbols are displayed at which of said outcome positions is based on the determined movement order.

7. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) display a matrix including a plurality of different positions, wherein prior to any movement of any player symbols and prior to any movement of any participant symbols:

(i) a plurality of said positions are each associated with one of a plurality of different outcomes, and (ii) the outcomes associated with the outcome positions are selected from the group consisting of: an award, a modifier of a value, a quantity of free spins, a quantity of free activations, an additional quantity of position moves, a quantity of picks, and a reduced quantity of position moves;

(b) display:

(i) a player symbol at one of the different positions, and (ii) at least one participant symbol at at least one of the different positions;

(c) randomly generate a quantity of position moves associated with the player symbol;

(d) determine a plurality of said positions available for the player symbol to move to, said determination based on the position the player symbol is displayed at and the generated quantity of position moves;

(e) enable a player to designate one of the determined plurality of said positions available for the player symbol to move to as a player destination position;

(f) for each participant symbol:

(i) determine a quantity of position moves, and (ii) designate one of the positions to move to as a participant destination position, said designation based on the position said participant symbol is displayed at and the determined quantity of position moves for said participant symbol;

(g) determine a movement order for the player symbol and the at least one participant symbol;

(h) prior to moving each of (i) the player symbol in association with the quantity of position moves associated with the player symbol, and (ii) each of the at least one participant symbol in association with the quantity of position moves associated with said participant symbol, if the designated player destination position is the same position as one of the designated participant destination positions:

(i) determine which one of the player symbol and the participant symbol to move to said designated destination position, and (ii) determine which one of the other one of the player symbol and the participant symbol to move to another one of said positions, wherein which of said player symbol and said participant symbol is determined to move to the designated position is based on the determined movement order;

(i) display at least one of the player symbol and the at least one participant symbol moving to at least one of the designated destination positions; and (j) provide the player the outcome associated with the moved to position of the player symbol.

8. The gaming system of claim 7, wherein at least one of the participant symbols is associated with another player.

9. The gaming system of claim 7, wherein when executed by the at least one processor, the plurality of instructions cause the at least one processor to randomly determine the quantity of position moves for at least one of the participant symbols.

10. The gaming system of claim 7, wherein when executed by the at least one processor, the plurality of instructions cause the at least one processor to determine the movement order based on each symbol's relative position to at least one of the positions.

11. The gaming system of claim 7, wherein when executed by the at least one processor, the plurality of instructions cause the at least one processor operate with the at least one display device to display a plurality of participant symbols.

12. The gaming system of claim 11, wherein when executed by the at least one processor if the designated destination position of at least two of the participant symbols is the same position, the plurality of instructions cause the at least one processor to operate with the at least one display device to:

(i) display one of the participant symbols at said designated destination position, and (ii) display the other one of the participant symbol at another one of said positions, wherein which of said participant symbols is displayed at the designated position is based on the determined movement order.

13. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) display:

(i) a matrix including a plurality of positions, wherein prior to any movement of any player symbols and prior to any movement of any participant symbols:

(A) a plurality of said positions are each associated with one of a plurality of different outcomes, and (B) the outcomes associated with the outcome positions are selected from the group consisting of: an award, a modifier of a value, a quantity of free spins, a quantity of free activations, an additional quantity of position moves, a quantity of picks, and a reduced quantity of position moves, (ii) a player symbol at a current one of the positions, and (ii) at least one participant symbol at a separate current one of the positions;

(b) for the player symbol:

(i) randomly generate a quantity of position moves, and (ii) for each of the generated quantity of position moves, enable a player to input a direction of movement;

(c) for each participant symbol:

(i) determine a quantity of positions moves, and (ii) for each of the quantity of position moves associated with the participant symbol, determine a direction of movement;

(d) prior to moving each of: (i) the player symbol in association with the quantity of position moves associated with the player symbol, and (ii) each of the at least one participant symbol in association with the quantity of position moves associated with said participant symbol, determine a movement order for the player symbol and the at least one participant symbol;

(e) after determining the movement order:

(i) display the player symbol moving to one of the positions, wherein the position the player symbol is moved to is based on at least a plurality of: the current position of the player symbol, the player inputted direction of movement and the determined movement order;

(ii) display each participant symbol moving to a separate one of the positions, wherein the position each participant symbol is moved to is based on at least a plurality of: the current position of said participant symbol, the determined direction of movement for said participant symbol and the determined movement order; and (f) repeat (b) to (e) at least once and until a terminating event occurs.

14. The gaming system of claim 13, wherein at least one of the participant symbols is associated with another player.

15. The gaming system of claim 13, wherein at least one of the participant symbols is associated with a bot.

16. The gaming system of claim 13, wherein when executed by the at least one processor when the terminating event occurs, the plurality of instructions cause the at least one processor provide the player any outcomes associated with any moved to positions.

17. The gaming system of claim 13, wherein the movement order is determined based on each symbol's relative position to at least one of the positions.

18. The gaming system of claim 13, wherein when executed by the at least one processor if the inputted direction of movement for the quantity of position moves associated with the player symbol corresponds to one of the positions and the determined direction of movement for the quantity of position moves associated with one participant symbol corresponds to said same position, the plurality of instructions cause the at least one processor to operate with the display device to:

(i) display one of the player symbol and the participant symbol at said position, and (ii) display the other one of the player symbol and the participant symbol at another one of said positions, wherein which of said player symbol and said participant symbol is displayed at which of said positions is based on the determined movement order.

19. The gaming system of claim 13, wherein when executed by the at least one processor, the plurality of instructions cause the at least one processor to operate with the display device to display each of a plurality of participant symbols.

20. The gaming system of claim 19, wherein when executed by the at least one processor if the inputted direction of movement for the quantity of positions moves associated with a first one of the participant symbols corresponds to one of the positions and the determined direction of movement for the quantity of position moves associated with a second one of the participant symbols corresponds to said same position, the plurality of instructions cause the at least one processor to operate with the display device to:

(i) display one of the first participant symbol and the second participant symbol at said position, and (ii) display the other one of the first participant symbol and the second participant symbol at another one of said positions, wherein which of said first and second participant symbols are displayed at which of said positions is based on the determined movement order.

* * * * *

UNITED STATES PATENT AND TRADEMARK OFFICE

CERTIFICATE OF CORRECTION

PATENT NO. : 8,888,580 B2
APPLICATION NO. : 12/914602
DATED : November 18, 2014
INVENTOR(S) : Scott A. Caputo et al.

It is certified that error appears in the above-identified patent and that said Letters Patent is hereby corrected as shown below:

IN THE CLAIMS

In Claim 1, Column 36, Line 25, between “the” and “participant” insert --at least one--.
In Claim 1, Column 36, Line 25, replace “symbols” with --symbol--.
In Claim 1, Column 36, Line 38, replace “positions” with --position--.
In Claim 2, Column 36, Line 64, after the second instance of “the” insert --at least one--.
In Claim 2, Column 36, Line 65, replace “symbols” with --symbol--.
In Claim 8, Column 38, Line 34, after the second instance of “the” insert --at least one--.
In Claim 8, Column 38, Line 35, replace “symbols” with --symbol--.
In Claim 11, Column 38, Line 48, between “processor” and “operate” insert --to--.
In Claim 12, Column 38, Line 58, replace “symbol” with --symbols--.
In Claim 13, Column 39, Line 10, delete “outcome”.
In Claim 13, Column 39, Line 27, replace “positions” with --position--.
In Claim 13, Column 39, Line 44, after “;” insert --and--.
In Claim 14, Column 40, Line 4, between “the” and “participant” insert --at least one--.
In Claim 14, Column 40, Line 4, replace “symbols” with --symbol--.
In Claim 15, Column 40, Line 6, between “the” and “participant” insert --at least one--.
In Claim 15, Column 40, Line 6, replace “symbols” with --symbol--.
In Claim 16, Column 40, Line 10, between “processor” and “provide” insert --to--.
In Claim 20, Column 40, Line 37, replace “positions” with --position--.

Signed and Sealed this
Second Day of February, 2016

Michelle K. Lee

Michelle K. Lee
*Director of the United States Patent and Trademark Office*